US011849530B2

(12) United States Patent
Hirshfield et al.

(10) Patent No.: US 11,849,530 B2
(45) Date of Patent: Dec. 19, 2023

(54) COMPACT CYCLOTRON RESONANCE HIGH-POWER ACCELERATION FOR ELECTRONS

(71) Applicant: Omega-P R&D, Inc., New Haven, CT (US)

(72) Inventors: Jay L Hirshfield, Orange, CT (US); Sergey V. Shchelkunov, North Branford, CT (US)

(73) Assignee: OMEGA-P R&D, INC., New Haven, CT (US)

( * ) Notice: Subject to any disclaimer, the term of this patent is extended or adjusted under 35 U.S.C. 154(b) by 0 days.

(21) Appl. No.: 18/028,146

(22) PCT Filed: Aug. 16, 2022

(86) PCT No.: PCT/US2022/040457
§ 371 (c)(1),
(2) Date: Mar. 23, 2023

(87) PCT Pub. No.: WO2023/023050
PCT Pub. Date: Feb. 23, 2023

(65) Prior Publication Data

US 2023/0262870 A1 Aug. 17, 2023

Related U.S. Application Data

(60) Provisional application No. 63/234,026, filed on Aug. 17, 2021.

(51) Int. Cl.
*H05H 13/00* (2006.01)
*H05H 7/02* (2006.01)

(52) U.S. Cl.
CPC ..... *H05H 13/005* (2013.01); *H05H 7/02* (2013.01); *H05H 2007/025* (2013.01); *H05H 2242/10* (2013.01)

(58) Field of Classification Search
None
See application file for complete search history.

(56) References Cited

U.S. PATENT DOCUMENTS 2,677,107 A 4/1954 Willenbrock et al.
3,398,376 A * 8/1968 Hirshfield ..... H01S 1/005 330/56

(Continued)

OTHER PUBLICATIONS

The International Search Report and Written Opinion dated Nov. 1, 2022, issued by the International Searching Authority in related International Application No. PCT/US22/40457.

*Primary Examiner* — Srinivas Sathiraju
(74) *Attorney, Agent, or Firm* — ArentFox Schiff LLP

(57) ABSTRACT

Apparatuses and methods for accelerating electrons including an electron source configured to provide a beam of electrons and an accelerator utilize electron cyclotron resonance acceleration (eCRA). The accelerator includes a radio frequency (RF) cavity having a longitudinal axis, one or more inlets, and one or more outlets and an electro-magnet substantially surrounding at least a portion of the cavity and configured to produce an axial magnetic field. At least one pair of waveguides couple the cavity to an RF source configured to generate an RF wave. The RF wave is a superposition of two orthogonal $TE_{111}$ transverse electric modes excited in quadrature to produce an azimuthally rotating standing-wave mode configured to accelerate the beam of electrons axially entering the cavity with non-linear cyclotron resonance acceleration.

28 Claims, 22 Drawing Sheets

(56) References Cited

U.S. PATENT DOCUMENTS

| | | | | |
|---|---|---|---|---|
| 3,442,758 | A | 5/1969 | Penfold et al. | |
| 6,060,833 | A | 5/2000 | Velazco | |
| 8,311,187 | B2 * | 11/2012 | Treas | H01J 35/16 315/505 |
| 9,196,449 | B1 * | 11/2015 | Chang | H01J 23/06 |
| 9,426,876 | B2 * | 8/2016 | Treas | H05H 9/02 |
| 10,895,540 | B1 * | 1/2021 | Gupta | A61B 6/03 |
| 11,031,206 | B2 * | 6/2021 | Graves | H01J 3/021 |
| 11,170,907 | B2 * | 11/2021 | De Jager | G21G 1/10 |
| 11,562,874 | B2 * | 1/2023 | Graves | H01J 29/488 |
| 2003/0141448 | A1 | 7/2003 | Symons | |
| 2007/0152610 | A1 * | 7/2007 | Yakovlev | H05H 7/22 315/501 |
| 2008/0024065 | A1 * | 1/2008 | Yakovlev | H05H 7/22 315/5.41 |
| 2016/0069030 | A1 * | 3/2016 | Kephart | C08J 3/28 404/108 |
| 2016/0147161 | A1 * | 5/2016 | Nikipelov | H01S 3/0903 355/67 |
| 2016/0174355 | A1 * | 6/2016 | Lal | H05H 9/045 315/505 |
| 2018/0366899 | A1 * | 12/2018 | Smorenburg | H05H 7/04 |
| 2019/0066859 | A1 * | 2/2019 | De Jager | G21G 1/12 |
| 2019/0069388 | A1 * | 2/2019 | Newsham | H05H 7/22 |
| 2019/0096627 | A1 * | 3/2019 | Ruan | H01J 37/263 |
| 2019/0224751 | A1 * | 7/2019 | Thangaraj | H01J 37/305 |
| 2020/0035442 | A1 * | 1/2020 | Otto | H03B 17/00 |
| 2020/0295522 | A1 * | 9/2020 | Whitney | H01S 3/08 |
| 2020/0316853 | A2 * | 10/2020 | Sauers | E01C 23/14 |
| 2021/0009443 | A1 * | 1/2021 | Geelhoed | C02F 1/305 |
| 2021/0274633 | A1 * | 9/2021 | Hannon | H05H 7/02 |
| 2021/0375498 | A1 * | 12/2021 | De Jager | G21G 1/10 |
| 2021/0400796 | A1 * | 12/2021 | Luiten | H05H 7/02 |
| 2022/0367141 | A1 * | 11/2022 | Cameron | H01J 37/265 |
| 2022/0396504 | A1 * | 12/2022 | Geelhoed | H05H 7/20 |
| 2023/0154722 | A1 * | 5/2023 | Bleeker | H01J 37/04 250/310 |

* cited by examiner

COMPACT CYCLOTRON RESONANCE HIGH-POWER ACCELERATION FOR ELECTRONS

CROSS REFERENCE TO RELATED APPLICATION

The present application is a National Stage entry of the International Application No. PCT/US22/40457, filed Aug. 16, 2022, which is related to and claims priority to U.S. Provisional Patent Application No. 63/234,026 entitled "eCRA: A COMPACT CYCLOTRON RESONANCE HIGH-POWER ACCELERATOR FOR ELECTRONS," filed on Aug. 17, 2021, the entire contents of which are incorporated by reference in their entirety.

TECHNICAL FIELD

Aspects of the present disclosure generally relate to apparatuses and methods for accelerating electrons.

BACKGROUND

Energetic charged particles have many usage applications in the fields of medicine, nuclear energy, testing, experimental research, national security, etc. Examples of energetic charged particles include ions, protons, electrons, and positrons. Conventional equipment used in producing energetic charged particles may require high investment cost and large facilities or real estate, while limiting the mobility of the equipment. Therefore, there continue to be unmet needs for improvements in the production of energetic charged particles.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In some aspects, the techniques described herein relate to a device, including: an electron source configured to provide a beam of electrons; and an accelerator including: a radio frequency (RF) cavity having a longitudinal axis, one or more inlets, and one or more outlets; an electro-magnet substantially surrounding at least a portion of the RF cavity and configured to produce an axial magnetic field; and at least one pair of waveguides coupling the RF cavity to an RF source configured to generate an RF wave, wherein the RF wave is a superposition of two orthogonal $TE_{111}$ transverse electric modes excited in quadrature to produce an azimuthally rotating standing-wave mode configured to accelerate the beam of electrons axially entering the RF cavity with non-linear cyclotron resonance acceleration.

In some aspects, the techniques described herein relate to a device, wherein the RF cavity is maintained at room temperature.

In some aspects, the techniques described herein relate to a device, wherein the RF cavity is a copper cavity including channels for water cooling.

In some aspects, the techniques described herein relate to a device, wherein the beam of electrons remains un-bunched.

In some aspects, the techniques described herein relate to a device, wherein parameters of the $TE_{111}$ modes are not tuned to conform to an auto-resonance condition.

In some aspects, the techniques described herein relate to a device, wherein the azimuthally rotating standing-wave mode allows slippage in phase between momentum of the electrons and the RF wave.

In some aspects, the techniques described herein relate to a device, wherein the slippage in phase favors energy transfer to the electrons and avoids energy transfer back to the RF wave.

In some aspects, the techniques described herein relate to a device, wherein the at least one pair of waveguides are coupled to the RF cavity at a 90 degree angle to each other.

In some aspects, the techniques described herein relate to a device, wherein temporal phases in the RF wave of the at least one pair of waveguides are separated by 90 degrees.

In some aspects, the techniques described herein relate to a device, wherein an electron in the accelerated beam of electrons exiting the RF cavity traces a circular helical pattern around a respective axis when the magnetic field is constant.

In some aspects, the techniques described herein relate to a device, wherein the RF cavity, the electro-magnet, and the electron source are arranged along a vertical axis, wherein the magnetic field is configured to deflect the accelerated beam of electrons to scan in a horizontal plane.

In some aspects, the techniques described herein relate to a device, wherein the RF cavity, the electro-magnet, and the electron source are arranged along a horizontal axis directed toward a target to be irradiated.

In some aspects, the techniques described herein relate to a device, wherein the accelerator is configured for pulsed operation with a maximum duty cycle based on the RF source or a surface-averaged peak areal power to be dissipated by walls of the RF cavity.

In some aspects, the techniques described herein relate to a device, wherein the pulsed operation provides a peak accelerating field in the cavity for accelerating the beam of electrons higher than continuous operation for the same average power.

In some aspects, the techniques described herein relate to a device, wherein the accelerator provides an effective acceleration gradient of at least 75 MeV/m with a maximum surface field of 40 MV/m when producing an electron beam with 4.5 MeV energy and at least a 300 kW power.

In some aspects, the techniques described herein relate to a device, wherein an efficiency of the accelerator is between 85% and 99%.

In some aspects, the techniques described herein relate to a method, including: receiving, at an RF cavity within an axial magnetic field, a beam of electrons via one or more inlets; applying a radio frequency (RF) wave to the RF cavity, wherein the RF wave is a superposition of two $TE_{111}$ orthogonal transverse electric modes excited in quadrature to produce a rotating standing-wave mode configured to accelerate the beam of electrons axially entering the RF cavity with non-linear cyclotron resonance acceleration; and emitting the accelerated beam of electrons via one or more outlets.

In some aspects, the techniques described herein relate to a method, further including maintaining the RF cavity at room temperature.

In some aspects, the techniques described herein relate to a method, further including pulsing the RF wave with a maximum duty cycle based on a limit of a RF source or a surface-averaged peak areal power to be dissipated by walls of the RF cavity.

In some aspects, the techniques described herein relate to a method, further including directing the accelerated beam of electrons toward a target, wherein the accelerated beam of electrons impinges on the target to create x-rays.

In some aspects, the techniques described herein relate to a method, wherein the RF cavity is arranged along a vertical axis, the method further including deflecting the accelerated beam of electrons to scan in a horizontal plane, wherein the target is cylindrical.

In some aspects, the techniques described herein relate to a method, wherein the x-rays are directed to one of: a medical device, food, or insect to be sterilized; an electronic or industrial weld or nuclear material to be inspected; or a well to be measured.

In some aspects, the techniques described herein relate to a method, further including directing the accelerated beam of electrons toward a waste stream to be irradiated.

In some aspects, the techniques described herein relate to a method, wherein a plurality of electrons within the beam of electrons remain un-bunched.

In some aspects, the techniques described herein relate to a method, wherein the beam of electrons exiting the RF cavity trace a circular helical pattern around respective axes when the magnetic field is constant.

In some aspects, the techniques described herein relate to a method, wherein parameters of the $TE_{111}$ modes are not tuned to conform to an auto-resonance condition.

In some aspects, the techniques described herein relate to a method, wherein the rotating standing-wave mode allows slippage in phase between momentum of the electrons and the RF wave.

In some aspects, the techniques described herein relate to a method, wherein the slippage in phase favors energy transfer to the electrons and avoids energy transfer back to the RF wave.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The features of various aspects of the disclosure are set forth in the appended claims. In the description that follows, like parts are marked throughout the specification and drawings with the same or similar numerals, respectively. The drawing figures are not necessarily drawn to scale, and certain figures may be shown in exaggerated or generalized form in the interest of clarity and/or conciseness. The disclosure itself, however, as well as a preferred mode of use, further advantages thereof, will be best understood by reference to the following detailed description of illustrative aspects of the disclosure when read in conjunction with the accompanying drawings.

DETAILED DESCRIPTION

Figure 1:
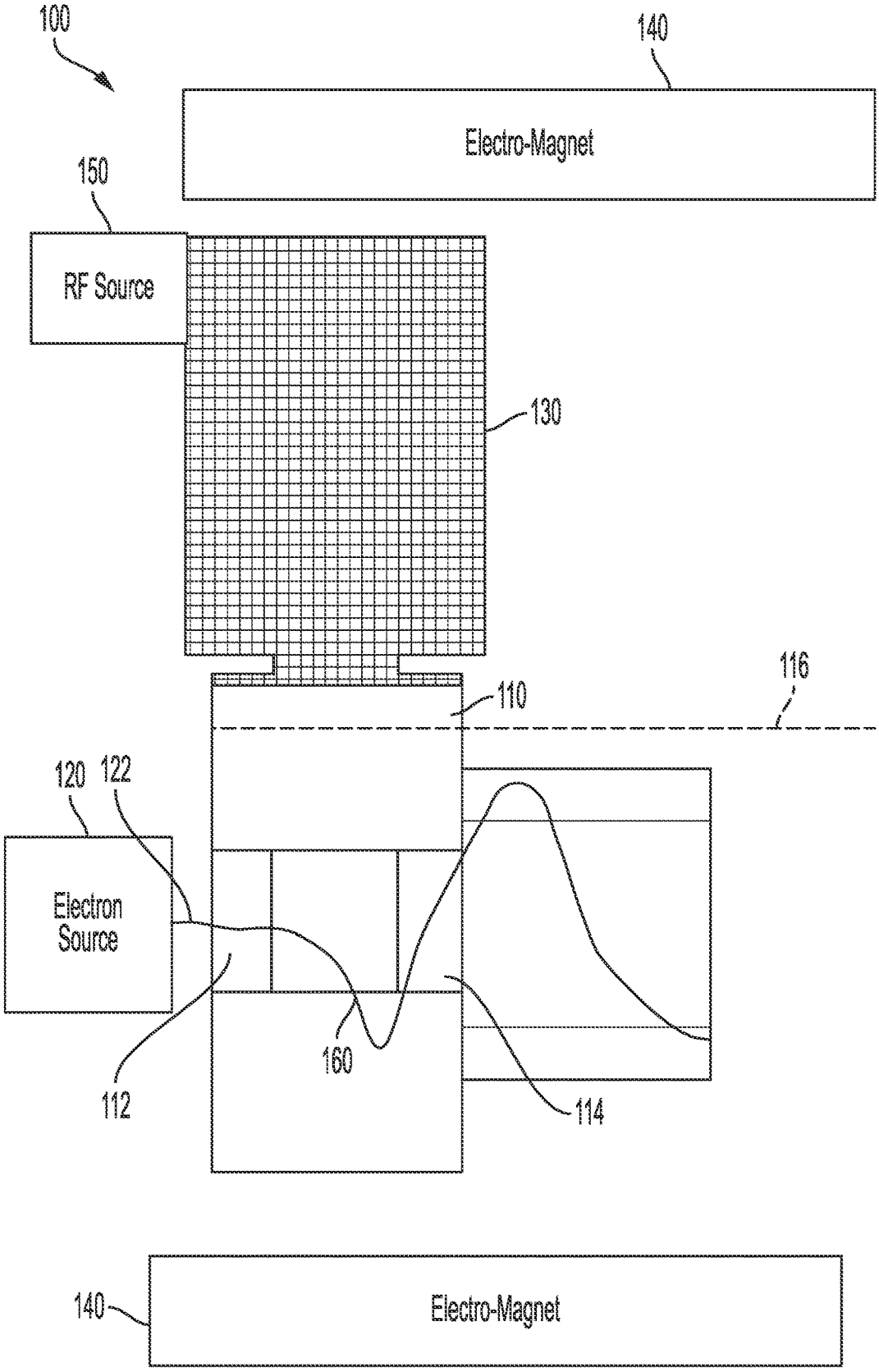
FIG. 1 is a schematic diagram illustrating some components of an electron cyclotron resonance acceleration (eCRA) system, in accordance with aspects of the present disclosure.

The following includes definitions of selected terms employed herein. The definitions include various examples and/or forms of components that fall within the scope of a term and that may be used for implementation. The examples in the description are not intended to be limiting.

Development of compact, efficient, low-cost, high-power electron accelerators is needed for scientific, national security, industrial, and commercial applications. Typically, these accelerators produce beams with average powers up to 100 kW although above, and particle energies of up to 10 MeV—a limit that is often imposed to minimize activation, neutron production, and shielding mass. In an aspect, it may be desirable for applications with greater power. Applications for MW-level beam powers exist for remediation of polluted wastewater streams, flue gas and other effluents; neutralization of toxic solid wastes; and numerous industrial processes. Lower power applications are in bremsstrahlung ("braking radiation") sources for sterilization of medical instruments and supplies, foodstuffs, and photonuclear reactions to produce radioisotopes, and for production of intense THz radiation.

One candidate for an industrial accelerator designed to meet these needs for some of these applications is the Cyclotron Auto-Resonance Accelerator (CARA). In CARA, a laminar continuous electron beam is injected along the axis of a $TE_{11}$-mode cylindrical waveguide that is immersed in an axial magnetic field. The waveguide is driven by exciting the two degenerate $TE_{11}$ traveling-wave modes in quadrature to comprise a rotating traveling wave, with parameters tuned to satisfy the auto-resonance condition.

$$\omega=\omega_c+k_z v_z \tag{1}$$

where $\omega$ is the wave's radian frequency; $k_z$ is the wave's axial wavenumber; $v_z$ is the axial velocity of the electrons; $\omega_c=eB/m\gamma$ is the relativistic cyclotron frequency for electrons with charge e and mass m in a static guide magnetic field B; and the relativistic energy factor (also referred to as a gamma-factor) is $\gamma=1+eV/mc^2$, with eV being the particle's kinetic energy upon acceleration through a voltage V and mcg its rest energy. In addition to satisfaction of Eq. 1, the waveguide dispersion relation $\omega^2=\Omega_o^2+k_z^2c^2$ must also be satisfied, where co, is the cutoff frequency. Prominent properties of a CARA beam include its absence of bunching, since—except for phase—it has been shown that all electrons in an idealized beam enjoy equal energy gain and no phase focusing. The absence of bunching mitigates against space-charge issues—including instabilities—that arise with dense bunches in high-current beams. Further, a CARA beam is self-rastering, since the beam particles trace helices as they exit along a diverging guide magnetic field and thus will constitute a beam that automatically scans upon impacting a target.

A serious limitation of the CARA mechanism is its intrinsic upper energy limit, given by $$\gamma_{max} = \gamma_0 + \left[\frac{\gamma_0^2 - 1}{1 - n^2}\right]^{1/2}, \tag{2}$$

where $\gamma_o$ and $\gamma_{max}$ are the initial and maximum relativistic energy factors. Here $n=ck_z/\omega=v_g/c$, with $v_g$ being the wave group velocity. This limit applies when auto-resonance, which can be written $\gamma(1-n\beta_z)$=const., is satisfied throughout the acceleration, where $\beta_z=v_z/c$ is the particle's normalized axial velocity. Auto-resonance can be satisfied during acceleration by either tapering the guide magnetic field, or by tapering the waveguide radius; the upper energy limit is the same for either option. For example, a 200 keV beam injected into a waveguide operating at a frequency just above cutoff for the $TE_{11}$ mode (0.293c/R), and then tapered up in radius by about 30% to just below cutoff for the next higher mode ($TM_{01}$), could not be accelerated to beyond 0.968 MeV, according to this formula. Here, R is the waveguide radius.

In an aspect, the present disclosure provides for an alternate concept for cyclotron resonance acceleration of electrons that employs a cavity (e.g., a cylindrical cavity) operating under conditions that do not conform to auto-resonance. Accordingly, performance of an accelerator according to this alternate concept can exceed limits imposed by the auto-resonance condition. The detailed numerical solutions of the highly non-linear equations that govern motion for electrons injected into a $TE_{111}$-mode cavity immersed in a strong axial magnetic field show power beyond the intrinsic limit of a CARA accelerator. The radio frequency (RF) fields of the cavity are a superposition of two orthogonal modes excited in quadrature to provide a rotating standing-wave mode. This interaction may be referred to as an electron cyclotron resonance acceleration (eCRA). In general, eCRA provides much higher upper energy limits than that given by Eq. 2. These higher energy limits arise when slippage in phase between the particle's momentum and the RF electric field moves from accelerating into decelerating ranges, or by particle interception on the cavity wall. The slippage in phase favors energy transfer to the electrons and avoids energy transfer back to the RF wave.

Generally, an eCRA system includes an electron source configured to provide a beam of electrons and an accelerator. The accelerator includes an RF cavity having a longitudinal axis, one or more inlets, and one or more outlets. The accelerator includes an electro-magnet substantially surrounding at least a portion of the cavity and configured to produce an axial magnetic field. The accelerator includes at least one pair of waveguides coupling the RF cavity to an RF source configured to generate a RF wave. The RF wave is a superposition of two orthogonal $TE_{111}$ transverse electric modes excited in quadrature to produce an azimuthally rotating standing-wave mode configured to accelerate the beam of electrons axially entering the cavity with non-linear cyclotron resonance acceleration.

Equations for the fields in an example idealized eCRA $TE_{111}$-rotating-mode cylindrical cavity, and the single-particle equations of motion for electrons injected into the cavity are provided. In some implementations, non-cylindrical cavities such as right rectangular parallelepipeds are possible. The cavity radius and height are R and L. A uniform static magnetic field $B_o$ aligned along the cavity axis of symmetry (z-axis) permeates the cavity and the space beyond. From solutions of the equations of motion, an eCRA system provides suitable power balance and RF-to-beam efficiency for several use cases. Modeling shows that there is no spatial bunching for the particles, so space charge forces and space charge perturbations of the vacuum fields may be assumed to be negligible even for high currents, whereas in bunched-beam accelerators such as cyclotrons and linacs, these effects may be non-negligible.

Turning to FIG. 1, schematic diagram illustrates some components of an eCRA system 100. The system 100 includes an RF cavity 110. For example, the RF cavity 110 may be a cylindrical cavity having a radius R and length L. The RF cavity 110 may have a longitudinal axis 116. In various implementations, the longitudinal axis 116 may be oriented vertically or horizontally. The RF cavity 110 includes one or more inlets 112 and one or more outlets 114. In some implementations, the RF cavity 110 is made of copper. In some implementations, the eCRA system 100 operates at room temperature. As used herein, "room temperature" refers to temperatures that do not cause the RF cavity 110 to be super-conductive. In some implementations, for example, the RF cavity 110 may be cooled by water or another suitable fluid. For instance, the RF cavity 110 may be cooled to within 0°-100° C., or preferably 20°-80° C. For example, in some implementations, the RF cavity 110 may include channels for cooling with a suitable liquid (e.g., water).

The system 100 includes an electron source 120 configured to provide a beam of electrons 122. The electron source 120 is aligned with the inlet 112 to axially inject the beam of electrons 122 into the cavity 110. For example, the electron source 120 may be an electron gun or electron emitter.

The system 100 includes at least one pair of waveguides 130 that couple the cavity 110 to an RF source 150. The waveguides 130 of a pair are oriented at a 90° angle to each other. For example, one waveguide 130 is illustrated with the other waveguide 130 of the pair being oriented into or out of the page. In some implementations, two pairs of waveguides are equally spaced at 90° angles around the cavity 110. Accordingly, each pair of waveguides is spatially orthogonal. As discussed in further detail below, the waveguides are excited in quadrature. That is, each waveguide 130 carries an RF wave that is orthogonal in phase (i.e., separated by 90°) to the RF wave of the paired waveguide 130. Each RF wave is a $TE_{111}$ transverse electric mode. The subscript (111) indicates that all electric components of the field are in a plane transverse to the axial direction. Further, within the cavity 110, the wave is an azimuthally rotating standing wave. That is, the nodes are fixed at the end walls of the cavity 110, but the wave rotates azimuthally about the longitudinal axis 116.

The system 100 includes a magnet 140 that substantially surrounds at least a portion of the cavity 110. In some implementations, due to the presence of the waveguides the magnet 140 may include two or more coils (e.g., on each side of the waveguides). The magnet may be a superconducting electro-magnet, an electro-magnet, a permanent magnet, and/or an electro-permanent magnet. The magnet 140 may be cooled to a critical temperature, or below, as needed for use and/or operation of any superconducting materials inside the magnet 140. The magnet 140 may include materials such as niobium titanium, niobium tin, vanadium gallium, magnesium diboride, bismuth strontium calcium copper oxide, yttrium barium copper oxide, and/or other suitable materials. In some implementations, the magnetic field strength of the magnet 140 may be 0.7 Tesla or less, where room temperature coils may operate. In other applications magnets with 1 Tesla, 2 Tesla, 5 Tesla, 7 Tesla, 10 Tesla, or other suitable field strength may be utilized. In some implementations, the magnet 140, or additional magnets may extend past the cavity 110 and control the accelerated electrons. For example, a reversal of the magnetic field may be used to deflect electrons into a plane perpendicular to the longitudinal axis of the system 100.

In an aspect, the beam of electrons 122 enters the cavity 110 and the electrons are accelerated with non-linear cyclotron resonance acceleration. For example, the electrons may follow a path 160, which traces a circular helical pattern about a respective axis when the magnetic field is constant.

It was found, depending on the RF-field strength (as characterized by $E_w$) and the magnitude of the guide magnetic field $B_o$, that electrons are accelerated, but can either reach and are transmitted through the end wall of the cavity, or can be reflected back. The walls of the idealized cavity are taken to be transparent to electrons.

Figure 2:
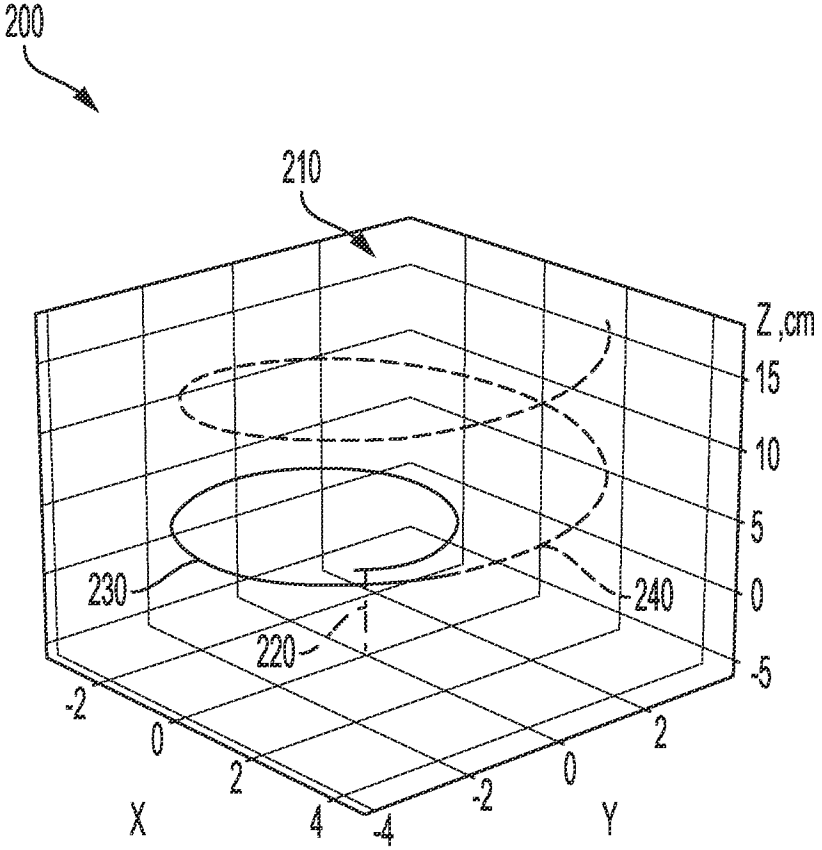
FIG. 2 is a plot of an example orbital path of an electron accelerated with cyclotron resonance acceleration out of a cavity, in accordance with aspects of the present disclosure.

FIG. 2 illustrates a plot 200 of an example orbital path 210 of an electron accelerated with cyclotron resonance acceleration out of a cavity 110. In the illustrated example, the cavity 110 has a radius R=6.0 cm and length L=6.113 cm. The injected particle had an energy of 100 keV. The electron enters the cavity 110 along a linear and axial path 220. Within the cavity 110, the electron follows a helical path 230. The electron continues on a helical path 240 after exiting the cavity 110. The electron achieves full acceleration to 10.13 MeV in only about one turn along the path 230.

Figure 3:
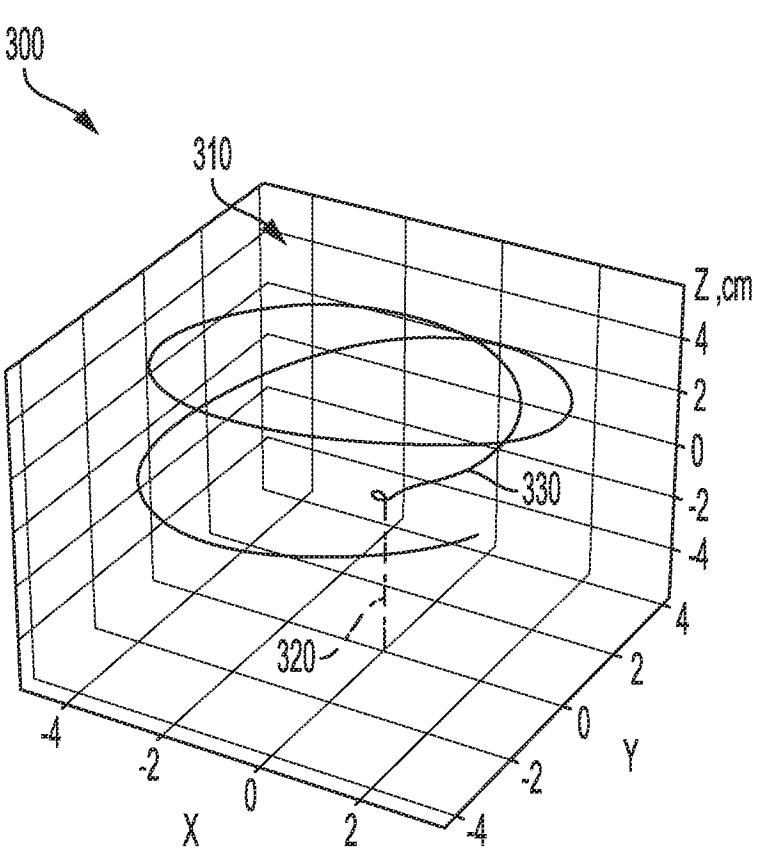
FIG. 3 is a plot of an example orbital path of an electron accelerated with cyclotron resonance acceleration that reflects within the cavity, in accordance with aspects of the present disclosure.

FIG. 3 illustrates a plot 300 of an example orbital path 310 of an electron accelerated with cyclotron resonance acceleration that reflects within the cavity. In the illustrated example, the cavity 110 has R=7.0 cm and L=5.84 cm. The injected particle had an energy of 100 keV. The electron enters the cavity along a linear and axial path 320. Within the cavity, the electron follows a helical path 330 but is reflected back toward the electron source 120. Parameters of the RF cavity, magnetic field, and/or injected beam may be selected to avoid reflection, as discussed in detail below.

The electric field components for the two (degenerate) linearly polarized $TE_{111}$ modes (also labeled in some texts as $H_{111}$ modes) are:

$$E_z(r, \varphi, z, t) = 0 \tag{3}$$

$$E_r(r, \varphi, z, t) = \begin{Bmatrix} E_{w,0} \\ E_{w,90} \end{Bmatrix} W \frac{J_1(k_c r)}{k_c r} \begin{Bmatrix} \sin(\varphi) \\ -\cos(\varphi) \end{Bmatrix} \sin(\beta z) \begin{Bmatrix} \cos(\omega t) \\ \sin(\omega t) \end{Bmatrix} \text{ and} \tag{4}$$

$$E_\varphi(r, \varphi, z, t) = \begin{Bmatrix} E_{w,0} \\ E_{w,90} \end{Bmatrix} W J_1'(k_c r) \begin{Bmatrix} \cos(\varphi) \\ \sin(\varphi) \end{Bmatrix} \sin(\beta z) \begin{Bmatrix} \cos(\omega t) \\ \sin(\omega t) \end{Bmatrix}, \tag{5}$$

where $J_1(x)$ is the Bessel function of the first kind of order one, $x_{11}$ is the first zero of $J_1'(x)$, $k_c = x_{11}/R$; $\beta = \pi/L$; $W = x_{11}/J_1(x_{11}) = 1.8411/0.58187 = 3.1642$ is a normalization factor; $E_w$ is the maximum electric field amplitude on the cavity walls, with sub-scripts 0 and 90 designating their relative phases. The corresponding magnetic field components are:

$$B_z(r, \varphi, z, t) = (k_c/\omega) \begin{Bmatrix} E_{w,0} \\ E_{w,90} \end{Bmatrix} W J_1(k_c r) \begin{Bmatrix} \cos(\varphi) \\ \sin(\varphi) \end{Bmatrix} \sin(\beta z) \begin{Bmatrix} \sin(\omega t) \\ -\cos(\omega t) \end{Bmatrix}, \tag{6}$$

$$B_r(r, \varphi, z, t) = (\beta/\omega) \begin{Bmatrix} E_{w,0} \\ E_{w,90} \end{Bmatrix} W J_1'(k_c r) \begin{Bmatrix} \cos(\varphi) \\ \sin(\varphi) \end{Bmatrix} \cos(\beta z) \begin{Bmatrix} \sin(\omega t) \\ -\cos(\omega t) \end{Bmatrix}, \text{ and} \tag{7}$$

$$B_\varphi(r, \varphi, z, t) = -(\beta/\omega) \begin{Bmatrix} E_{w,0} \\ E_{w,90} \end{Bmatrix} W [J_1(k_c r)/k_c r] \begin{Bmatrix} \sin(\varphi) \\ \cos(\varphi) \end{Bmatrix} \cos(\beta z) \begin{Bmatrix} \sin(\omega t) \\ \cos(\omega t) \end{Bmatrix}, \tag{8}$$

where $\omega = \sqrt{k_c^2 + \beta^2}$.

These equations are written out in full, since the forms for rotating modes are not found in most literature sources, the phase factors are important, and the normalization differs from convention. When $E_{w,0}=E_{w,90}$ the sum of both components are such that $E_r$, $B_z$, and $B_r$ vary as $\sin(\varphi-\omega t)$, while $E_\varphi$ and $B_\varphi$ vary as $\cos(\varphi-\omega t)$: namely circular clockwise rotating polarization; otherwise the polarization is elliptical. These equations represent the fields in an idealized cylindrical cavity, free of coupling irises for the applied RF (e.g., waveguides 130) and apertures (e.g., inlet 112 and outlet 114) for entry and exit of the electron beam.

The single-particle equations of motion are:

$$ds=cdt \tag{9}$$

$$P=\gamma(\hat{e}_x\beta_x+\hat{e}_y\beta_y+\hat{e}_z\beta_z) \tag{10}$$

$$\gamma=\sqrt{1+p\cdot p} \tag{11}$$

$$r=(\hat{e}_x x+\hat{e}_y y+\hat{e}_z z) \tag{12}$$

$$dr/ds=p/\gamma \tag{13}$$

$$dp/ds=-(e/mc_2)(E+cp\times B/\gamma) \tag{14}$$

where dt is the time interval; (x, y, z) are the particle's Cartesian coordinates, E is the total electric field at the particle location, and B is the total magnetic field at the particle location, including both the RF and static components, the latter designated as $B_o$. Table 1 provides examples of cavity dimensions and surface areas for $TE_{111}$ cavities that resonate at 2.856 GHz. In an aspect, 2.856 GHz is used as an example due to availability of RF sources at this frequency, but cavities can be designed to resonate at other frequencies.

TABLE 1

| | | | | | | | | |
|---|---|---|---|---|---|---|---|---|
| radius R (cm) | 3.50 | 4.00 | 4.50 | 5.00 | 5.50 | 6.00 | 6.50 | 7.00 |
| length L (cm) | 11.00 | 8.21 | 7.19 | 6.66 | 6.33 | 6.11 | 5.96 | 5.84 |
| surface area ($cm^2$) | 318.9 | 306.9 | 330.5 | 366.2 | 408.9 | 456.6 | 508.8 | 564.9 |

Figure 4:
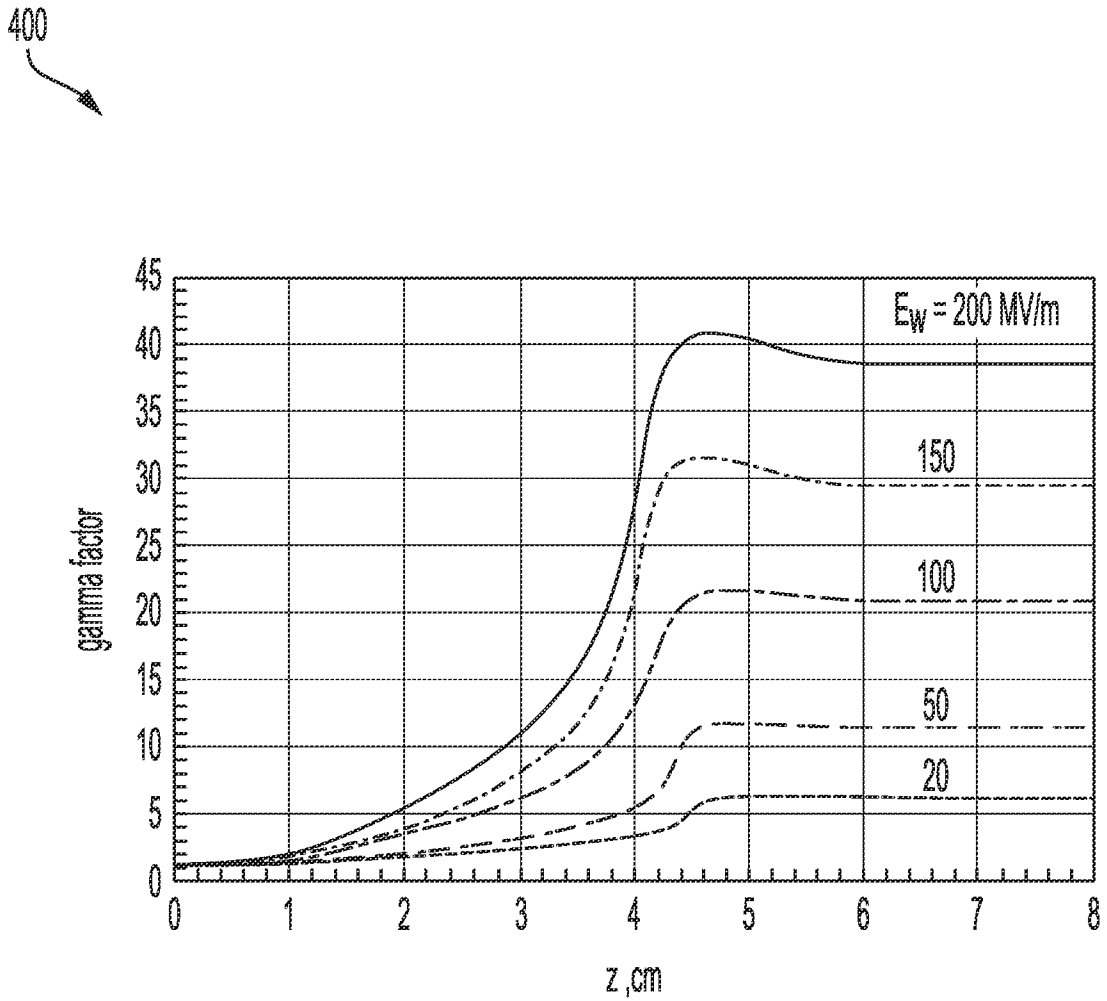
FIG. 4 illustrates examples of energy gain for a range of cavity fields as functions of axial distance along the cavity, in accordance with aspects of the present disclosure.

FIG. 4 is a chart 400 showing examples of energy gain for a range of cavity fields $E_w$ as functions of axial distance along the cavity. The examples show a gain of relativistic energy factor γ of non-reflected electrons in an eCRA cavity 110 for the indicated values of maximum RF electric field at the wall $E_w$. These examples are for a cavity with R=6.0 cm and L=6.113 cm, with injected particles having energies of 100 keV. Energy gain is seen to be mainly in the ~3-cm central region of the cavity where the E-fields are strongest; but the nominal acceleration gradient values described herein are equal to the energy gain divided by the full cavity length. For the 100 MV/m case, for example, a 10.13 MeV gain in 6.113 cm corresponds to an acceleration gradient of 166 MeV/m. For typical linear accelerators, the maximum E-field at the wall usually exceeds the acceleration gradient, whereas with an eCRA accelerator the opposite is the case. Other parameters for FIG. 4 are listed in Table 2.

TABLE 2

| | | | | | |
|---|---|---|---|---|---|
| $E_w$ (MV/m) | 20 | 50 | 100 | 150 | 200 |
| $B_o$ (T) | 0.331 | 0.535 | 0.914 | 1.297 | 1.656 |
| final electron energy (MeV) | 2.68 | 5.31 | 10.13 | 14.59 | 19.25 |
| nominal acceleration gradient (MV/m) | 43.8 | 86.9 | 165.7 | 238.7 | 314.9 |

Figure 6:
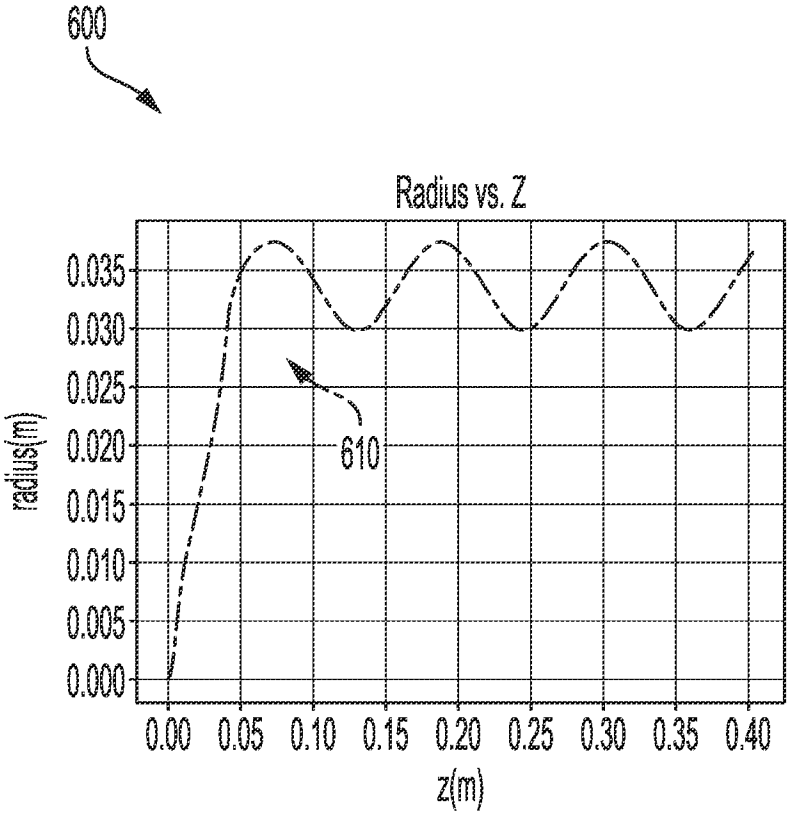
FIG. 6 is a chart depicting the radial coordinate for a particle as a function of its distance from the cavity entrance, in accordance with aspects of the present disclosure.
Figure 5:
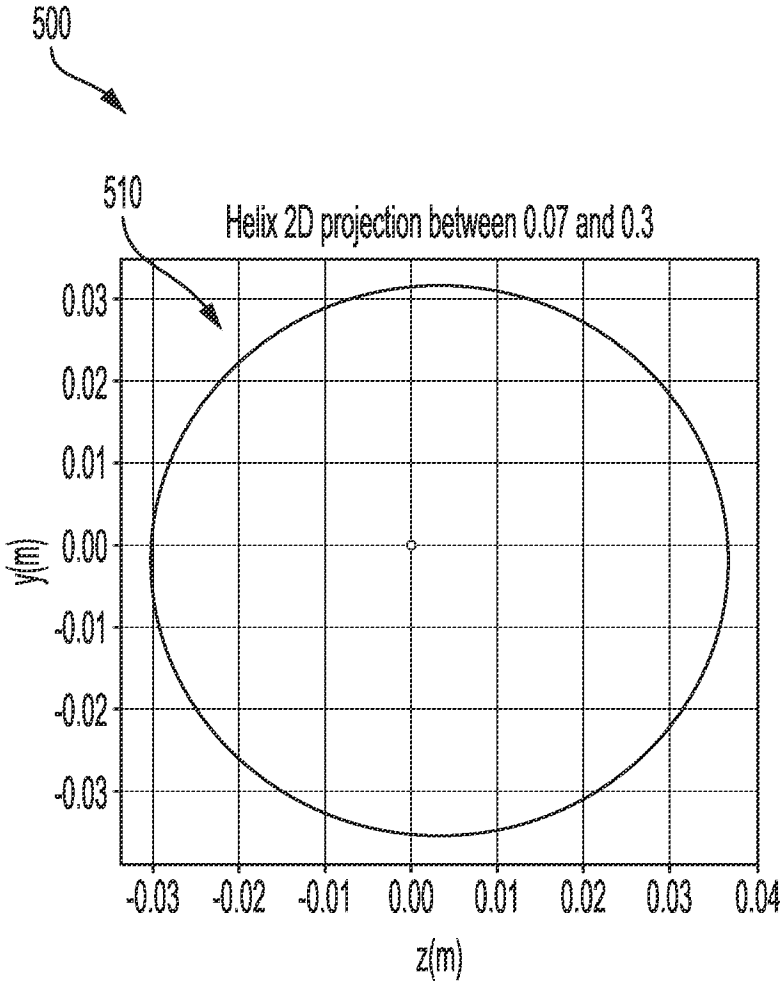
FIG. 5, illustrates a circular helical pattern traced by the beam of electrons exiting the cavity, in accordance with aspects of the present disclosure.

Electrons of identical energies and zero transverse momenta that enter the cavity on axis (x=y=0) but at different times within an RF cycle will evolve identically in their energy gains, but will emerge from the cavity at different radii and different azimuthal angles. An example of this is shown in FIG. 5, which illustrates a circular helical pattern 500 traced by the beam of electrons exiting the cavity. In an aspect, the beam of accelerated electrons trace a circular helical pattern around respective axes when the magnetic field is constant. For example, the circular helical pattern 500 includes a projection 510 on a transverse plane of the helical motion of a single accelerated particle orbiting on a circle whose center is offset from the cavity axis. This offset is caused by a small transverse v×B kick encountered as particles enter the cavity. This kick arises from the strong RF B-field on the inner cavity surface, so the azimuthal angle of this kick varies cyclically with the RF phase. This variation is illustrated another way in FIG. 6, which is a chart 600 depicting the radial coordinate 610 for a particle as a function of its distance z from the cavity entrance. The periodic variation of about 0.35 cm comes from the eccentric nature of the circular orbit, while the drop in radial coordinate near z=0 is because the particle is still within the cavity and has thus received only partial acceleration. All particles exhibit the same behavior, except for their variation in azimuth angle. The imprint of such a beam on a fixed target normal to the axis is an accumulation of loci where particles in a continuous stream moving on offset helical orbits intersect the target. This superposition is centered on the axis. The particles are uniformly distributed in azimuth, and lie on a circle at other target locations, so long as the axial field $B_o$ remains constant. The uniform distribution of points confirms the absence of azimuthal bunching in the eCRA interaction; it should be understood to be fundamental, since the idealized system has full azimuthal symmetry. But the radius of this uniform distribution will vary slightly with z as depicted in FIG. 6, since the proration of azimuthal and radial momenta varies slightly with z, even as all electrons have identical energies. That latter fact, plus the identical angular momenta of all electrons with respect to their own axes, also shows that all electrons have equal longitudinal momentum; therefore no longitudinal bunching.

The variation in beam radius with z in this idealized model of eCRA may be of minor significance in applications where the precise beam location on a target is not of consequence. Still, the variation may pose a problem where interaction of the beam with a circuit is intended, as in a THz source. But in reality the magnitude of the transverse kick may be minimized by design of the entrance aperture (e.g., inlet 112) of the cavity 110 for the beam, since the design can effect a reduction of the RF B-field near the entrance.

Figure 7B:
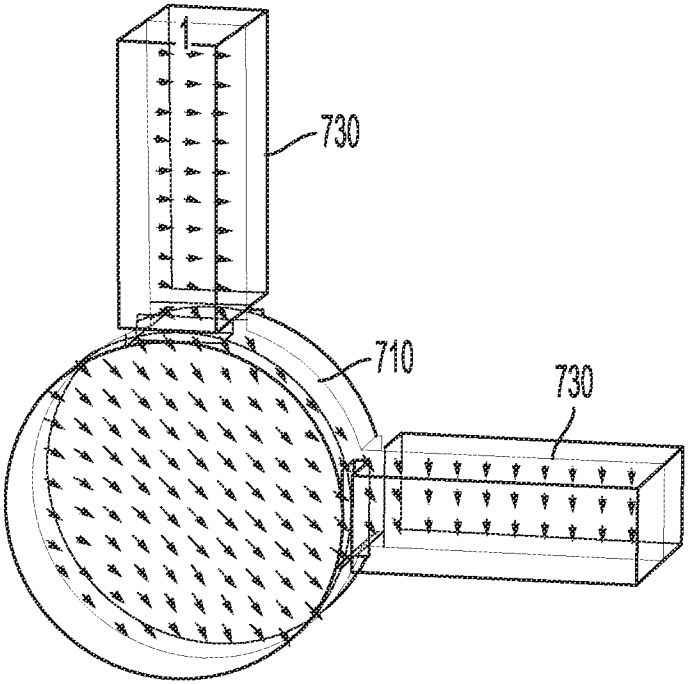
FIGS. 7A and 7B are diagrams illustrating example radio frequency (RF) electric fields within an RF cavity for both $TE_{111}$ transverse electric modes, in accordance with aspects of the present disclosure.
Figure 7A:
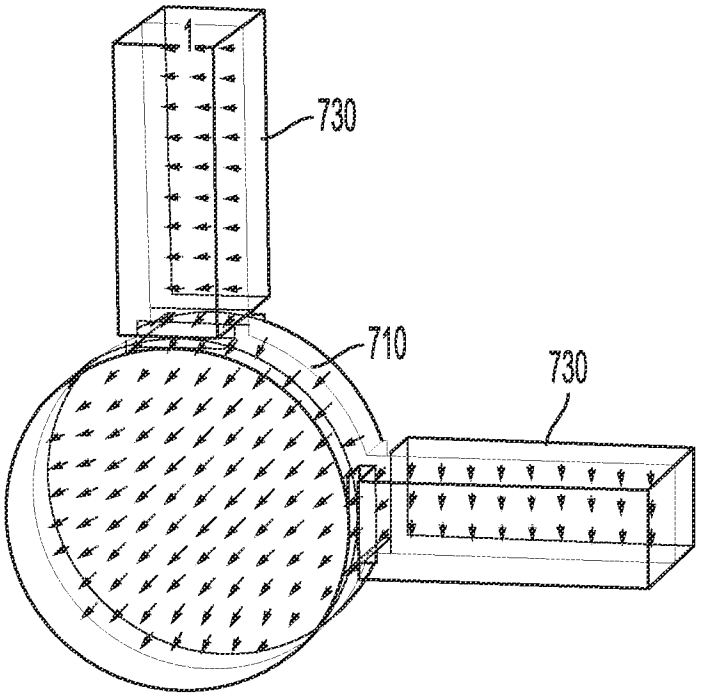

FIGS. 7A and 7B are diagrams illustrating example RF electric fields within an RF cavity 710 for both $TE_{111}$ modes.

The RF cavity 710 may be an example of the RF cavity 110. In the illustrated example, the waveguides 730 may be WR-284 input waveguides. The coupling slots provide $\beta$=9.9, where $\beta$ is the coupling coefficient. The input RF power via the waveguides 130 with a 90° phase difference generates a rotating field.

Figure 8A:
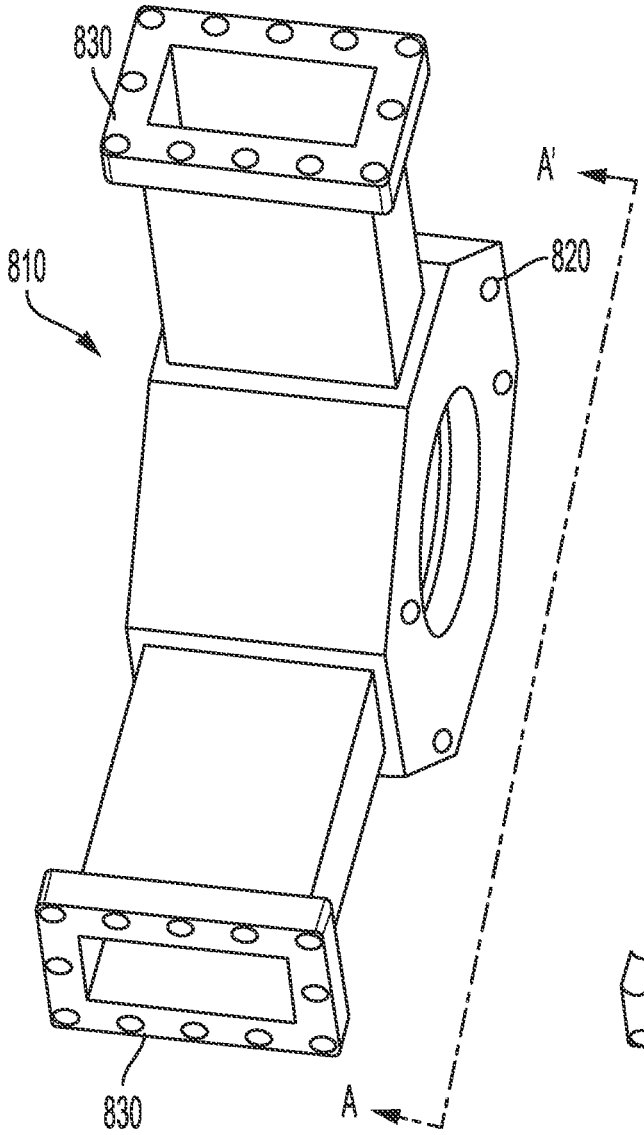
FIG. 8A is a diagram of another example RF cavity with waveguide couplers, in accordance with aspects of the present disclosure.

FIG. 8A is a diagram of another example RF cavity 810 with waveguide couplers 830. As discussed above, the waveguide couplers 830 are arranged at a 90° angle to each other. In some implementations, the RF cavity 810 may include channels 820, which may receive a suitable fluid (e.g., water) to cool the RF cavity 810 to maintain a room temperature.

Figure 8B:
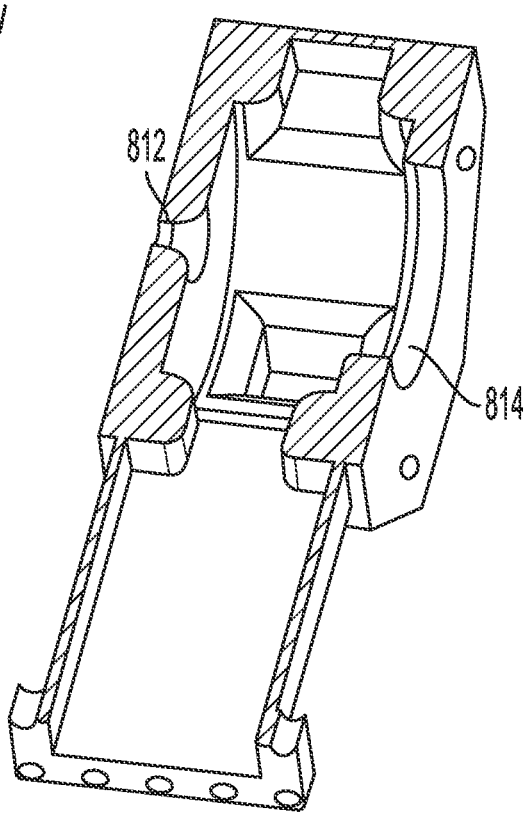
FIG. 8B is a cross-sectional view of the RF cavity of FIG. 8A.

FIG. 8B is a cross-sectional view of the RF cavity 810 of FIG. 8A along the line A-A'. The RF cavity 810 may include an inner wall 812 defining an inlet 112, which may also be referred to as an aperture. The RF cavity 810 may include an inner wall 814 defining an outlet 114.

Figure 9:
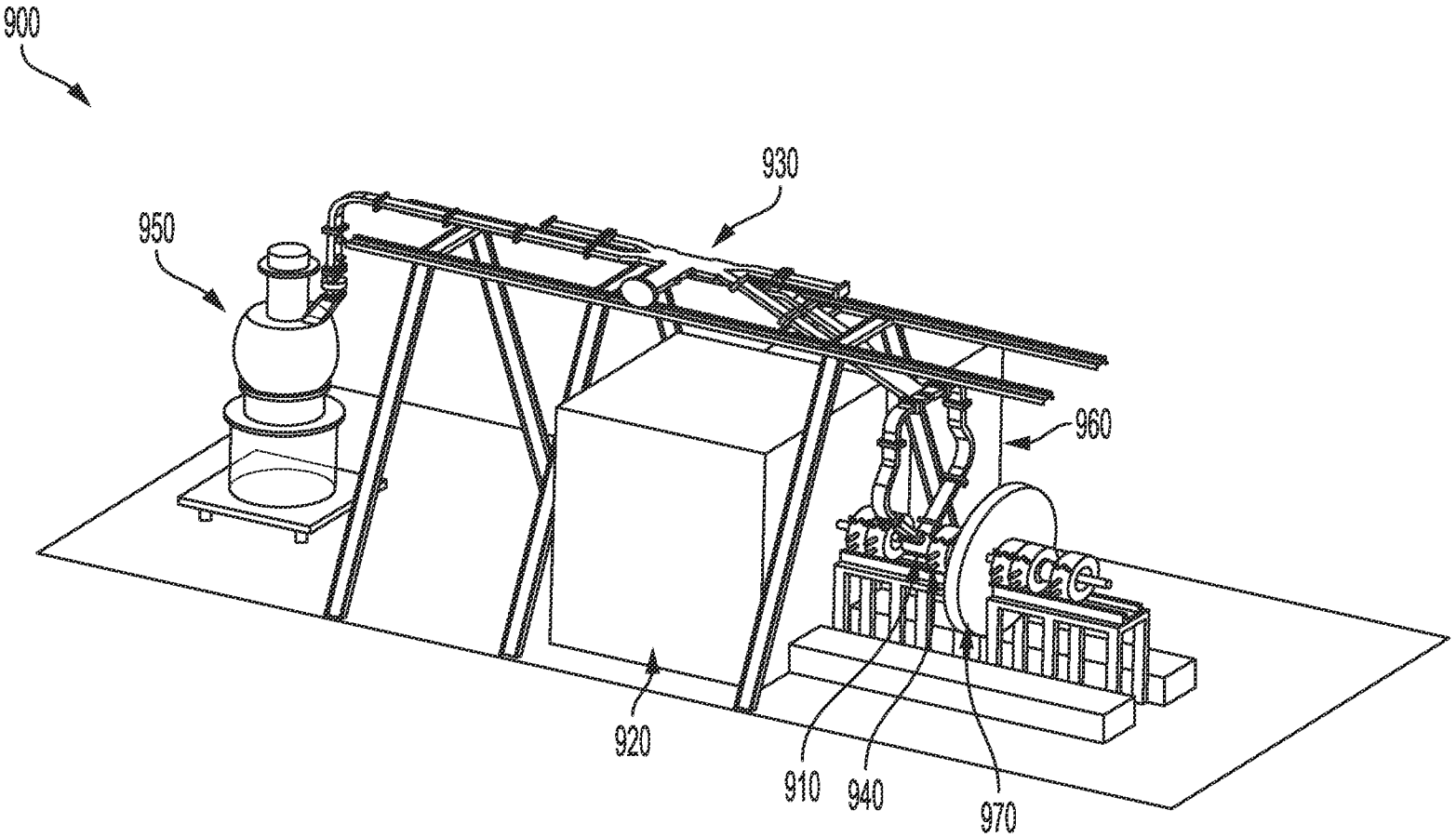
FIG. 9 is a diagram of another example eCRA system, in accordance with aspects of the present disclosure.

FIG. 9 is a diagram of another example eCRA system 900. The eCRA system 900 includes an electron source 920, an RF cavity 910, a waveguide circuit 930, magnets 940, an RF source 950, and a modulator 960. In an implementation, the RF components are S-band components (e.g., 2.856 GHz). For example, the RF source 950 may be a klystron such as an XK-5 klystron. The waveguide circuit 930 may be a WR-248 waveguide circuit including directional couplers, a variable power device and a 3-dB hybrid. The 3-dB hybrid may split the power equally with a 90° phase difference into the waveguides 130 that drive the RF cavity 810. The electron source 920 may be an e-gun tank controlled by the modulator 960.

In an example, the eCRA system 900 is oriented horizontally. A target section 970 located after the cavity 810 may produce a fan of x-rays. For example, the target section 970 may include a target such as a heavy metal that produces x-rays when the accelerated electron beam impinges on the target. The x-rays may be further directed toward a medical device, food, or insect to be sterilized; an electronic or industrial weld or nuclear material to be inspected; or a well to be measured. The target section 970 may include additional magnets to control the accelerated beam. For example, an increase in the magnetic field may cause the projection 510 to reduce in radius. Another possible design of the target section 970 may include an open beyond-cutoff pipe (e.g., if the beam orbits have smaller radii than the pipe radius). Another possible design of the target section 970 may include an aluminum or titanium foil end-wall for the cavity (with vacuum on both sides). The aluminum or titanium foil end-wall may have a thickness of 20-100 microns and absorb on the order of 50 keV of e-beam energy. Another possible design of the target section 970 may include a pipe with periodic wall variations that provide Bragg-type reflections, having an inner radius large enough to pass the accelerated beam.

Figure 10:
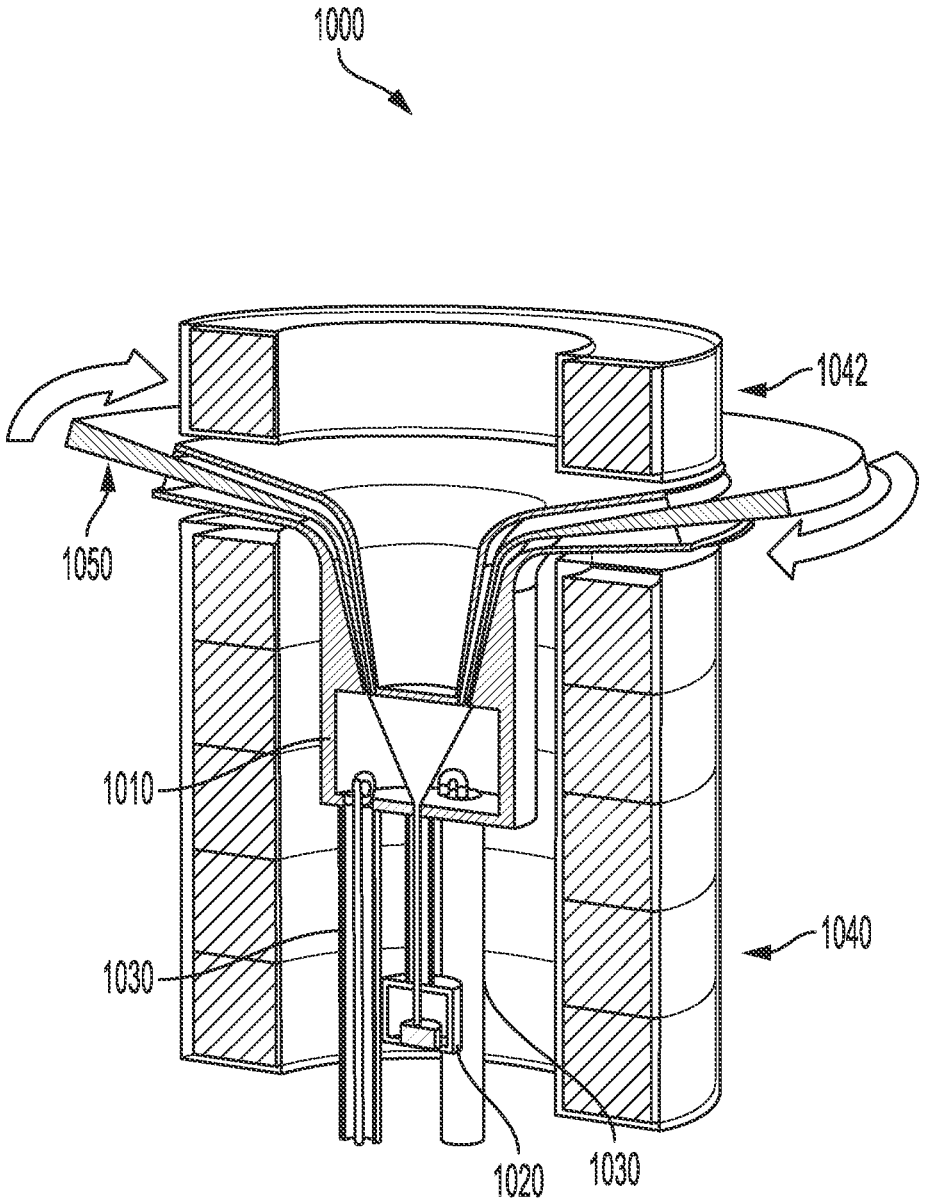
FIG. 10 is a diagram of an example vertical configuration of an eCRA system, in accordance with aspects of the present disclosure.

FIG. 10 is a diagram of an example vertical configuration of an eCRA system 1000. The eCRA system 1000 may include an electron source 1020, an RF cavity 1010, waveguides 1030, and magnets 1040. The vertical configuration may provide an e-beam that is deflected to scan in a horizontal plane to impinge on a distributed cylindrical target for producing a circular fan of energetic x-rays. For example, accelerated beam of electrons exiting the RF cavity 1010 may enter a magnetic field reversal region 1042 generated by the magnets 1040. The reversal of the magnetic field may cause the accelerated beam of electrons to deflect so as to exit a window or impinge on a target which then scan in a horizontal plane. For instance, the magnetic field reversal may generate a cusp that causes the deflection of the e-beam into a horizontal plane 1050. For example, optimization of the magnetic field profile across the RF cavity, and throughout the field reversal region 1042 may lead to radial extraction of the accelerated e-beam.

Figure 11:
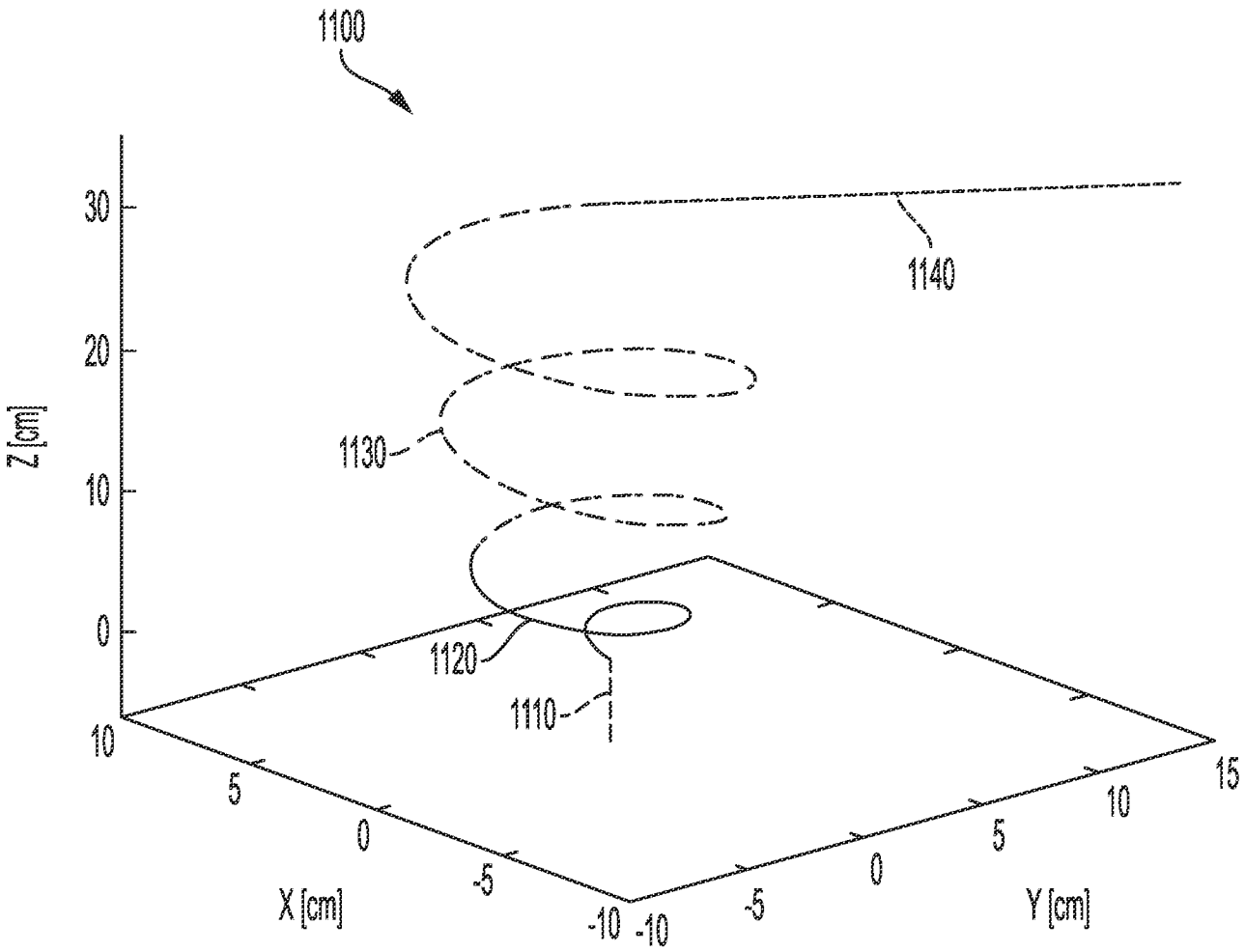
FIG. 11 illustrates an example path of an electron that is deflected, in accordance with aspects of the present disclosure.

FIG. 11 illustrates an example path 1100 of an electron that is deflected. For example, the path 1100 may correspond to a path of an electron in the eCRA system 1000. For example, the orbit may follow a field-reversed B-field to impact a cylindrical x-ray target. The electron may follow an axial path 1110 prior to entering the cavity. The electron may be accelerated according to cyclotron resonance acceleration along the path 1120 within the cavity 1010. As the electron exits the cavity 1010, the path 1130 may include a radially expanding orbit. When the electron enters the field reversal region 1042, the electron may follow a horizontal path 1140. Such orbits rotate with the phase of the RF fields to allow production of a fan of x-rays.

Figure 12:
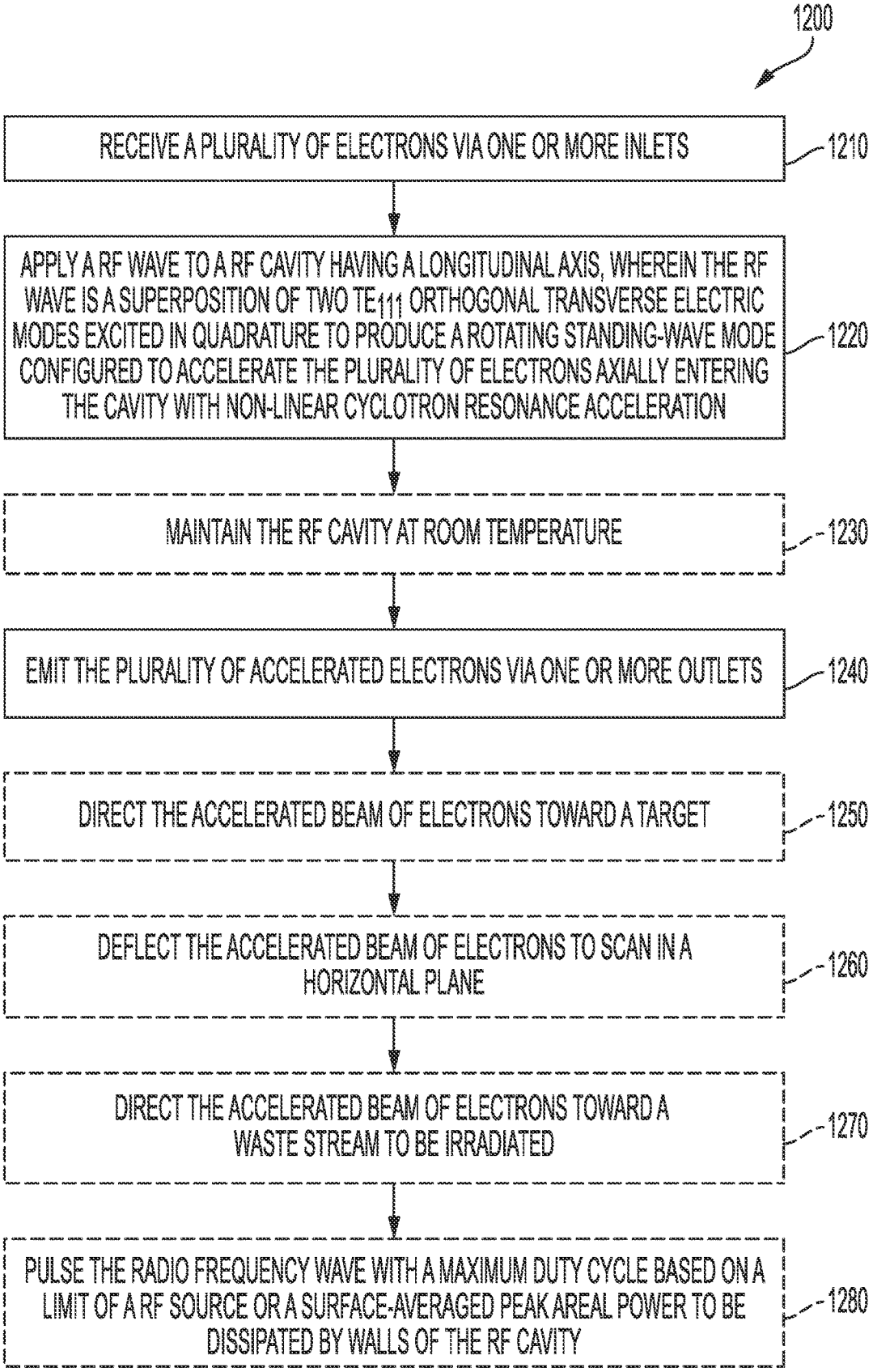
FIG. 12 is a flowchart of an example method for accelerating electrons, in accordance with aspects of the present disclosure.
Figure 13A:
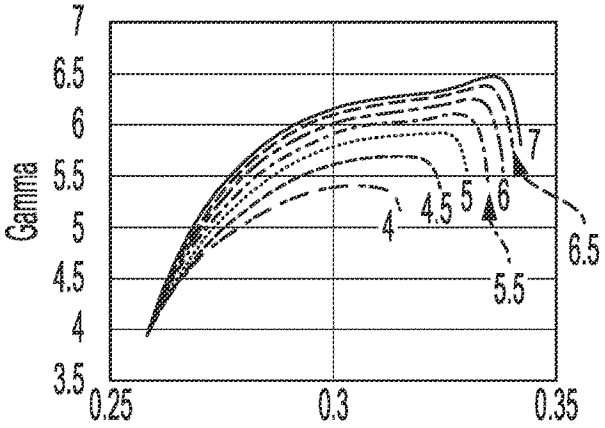
FIGS. 13A-D are a set of charts illustrating behavior of example values of a relativistic energy factor versus magnetic field, in accordance with aspects of the present disclosure.
Figure 13B:
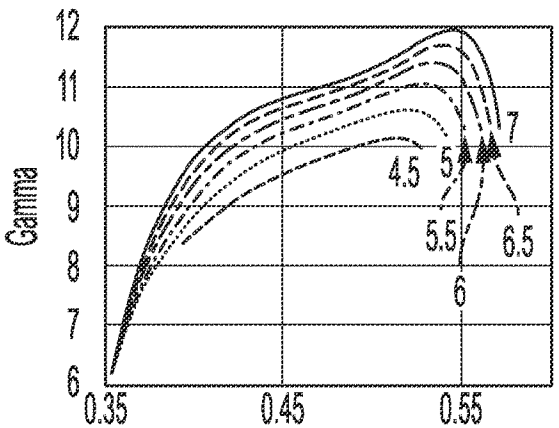
Figure 13C:
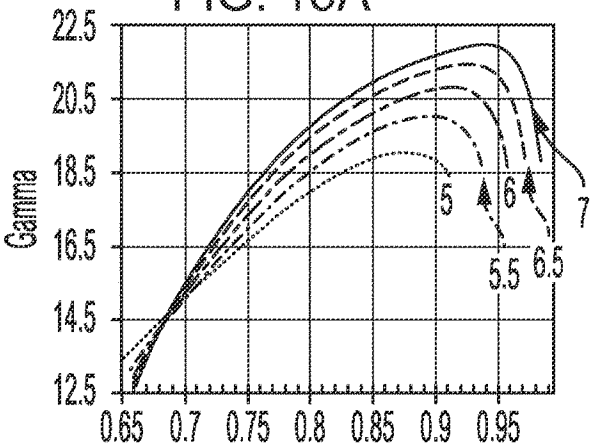
Figure 13D:
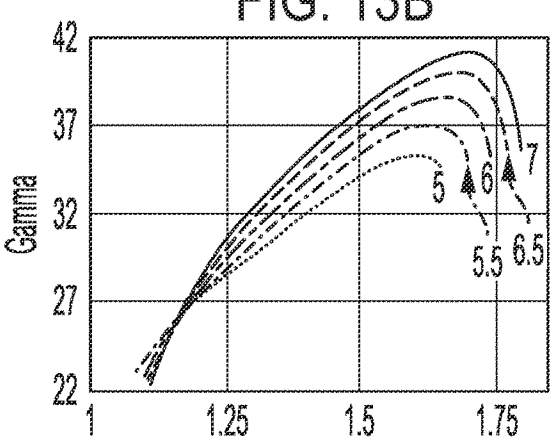

Turning now to FIG. 12, a flowchart of an example method 1200 for accelerating electrons may be performed by the eCRA system 100 (FIG. 1), the eCRA system 900 (FIG. 9), or the eCRA system 1000 (FIG. 10), for example.

At block 1210, the method 1200 may include receiving a plurality of electrons via one or more inlets. For example, the cavity 110, 910, or 1010 may receive the plurality of electrons via one or more inlets (e.g., inlet 112). For instance, the electron source 120, 920, or 1020 may provide a beam of electrons.

At block 1220, the method 1200 may include applying an RF wave to an RF cavity having a longitudinal axis, wherein the RF wave is a superposition of two $TE_{111}$ orthogonal transverse electric modes excited in quadrature to produce a rotating standing-wave mode configured to accelerate the beam of electrons axially entering the cavity with non-linear cyclotron resonance acceleration. For example, an RF source (e.g., RF source 150 or 950) may apply an RF wave to the cavity 110, 910, or 1010 via the waveguides 130, 930, or 1030. The RF wave is a superposition of two $TE_{111}$ orthogonal transverse electric modes excited in quadrature to produce a rotating standing-wave mode. For instance, as illustrated in FIGS. 7A and 7B the waveguides are spatially separated by 90° and the fields are separated by 90° in temporal phase. The rotating standing wave mode may cause the beam of electrons axially entering the cavity 110, 910, or 1010 with non-linear cyclotron resonance acceleration (e.g., according to path 160, 210, or 1120).

At block 1230, the method 1200 may optionally include maintaining the RF cavity at room temperature. For example, a cooling fluid (e.g., water) may be applied to an exterior and/or interior surface of the cavity 110, 910, or 1010 to maintain the RF cavity at room temperature. For example, the channels 820 in the RF cavity 810 may carry water or another cooling fluid to cool the RF cavity 810. In some implementations, the RF field applied to the RF cavity 810 may be selected to limit cavity wall heating to 100 W/cm2, which may be cooled to room temperature with a suitable liquid. Maintaining the RF cavity at room temperature may prevent embrittlement of the RF cavity.

At block 1240, the method 1200 may include emitting the plurality of accelerated electrons via one or more outlets. For example, the cavity 110, 910, or 1010 may emit the plurality of accelerated electrons via one or more outlets (e.g., outlet 114).

At block 1250, the method 1200 may optionally include directing the plurality of accelerated electrons toward a target. For example, the magnet 140, 940, 1040, may control a width of the beam of accelerated electrons. In some implementations, the beam of electrons exiting the cavity trace a circular helical pattern around respective axes when the magnetic field is constant. In some implementations, the accelerated beam of electrons impinges on the target to create x-rays. For example, the target may be a heavy metal. The x-rays may be directed toward one of: a medical device, food, or insect to be sterilized; an electronic or industrial weld or nuclear material to be inspected; or a well to be measured.

At block 1260, the method 1200 may optionally include deflecting the accelerated beam of electrons to scan in a horizontal plane. For example, the magnet 140, 940, or 1040 may generate a field reversal region 1042 that generates a cusp that causes the deflection. In some implementations, the cavity, electro-magnet, and electron source are arranged vertically and the target is cylindrical. Accordingly, the beam of electrons impinging on the target may generate a horizontal fan of x-rays.

At block 1270, the method 1200 may optionally include directing the accelerated beam of electrons toward a waste stream to be irradiated. For example, the RF cavity, electro-magnet, and electron source may be arranged along a horizontal axis directed toward a target to be irradiated.

At block 1280, the method 1200 may optionally include pulsing the RF wave with a maximum duty cycle based on a limit of an RF source or a surface-averaged peak areal power to be dissipated by walls of the RF cavity. In an aspect, for example, the RF source 950 may be controlled to pulse the RF wave. The electron source 120, 920, or 1020 may also be pulsed. In an aspect, the pulsed operation provides a higher peak power for an energy of the accelerated beam of electrons.

FIGS. 13A-D are a set of charts illustrating behavior of example values of $\gamma$ vs. $B_o$ for indicated valued of $E_w$ as electrons exit cavities of various radii. Curves are labeled according to the cavity radius R in cm. Energies of accelerated electrons in these examples are between about 2 and 20 MeV. There is a value of $B_o$ for which the gamma-factor is maximized. For each cavity radius and at given values of $E_w$, a range of values of $B_o$ can be found where an electron will not be reflected as it is accelerated. This behavior was explored for values of $E_w$ between 20 and 200 MV/m, with a step-size of 10 MV/m. Values of $B_o$ were scanned for with a step-size of 10-3 T. A few examples are shown in FIG. 13, where the final values of $\gamma$ at the cavity exit are plotted versus $B_o$ for the four indicated values of $E_w$. These considerations show that eCRA can evolve into an accelerator of widely varying beam energy, as can be achieved by adjustment of the RF power level and associated values of magnetic field $B_o$.

Figure 14B:
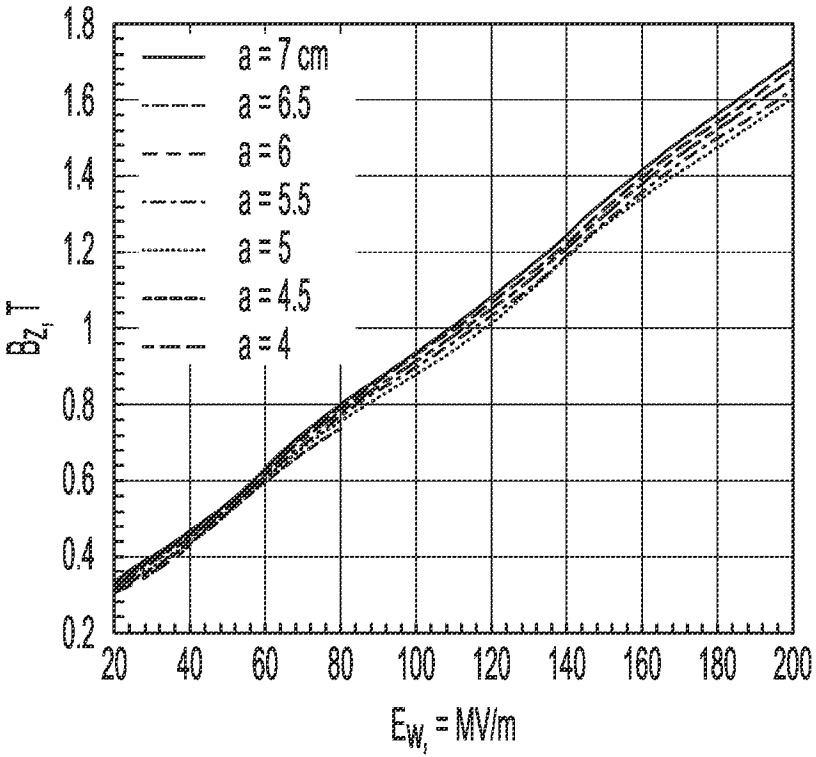
FIGS. 14A-B are a set of charts illustrating example maximum gamma factors and corresponding values of the magnetic field for which the gamma-factor is maximized, in accordance with aspects of the present disclosure.
Figure 14A:
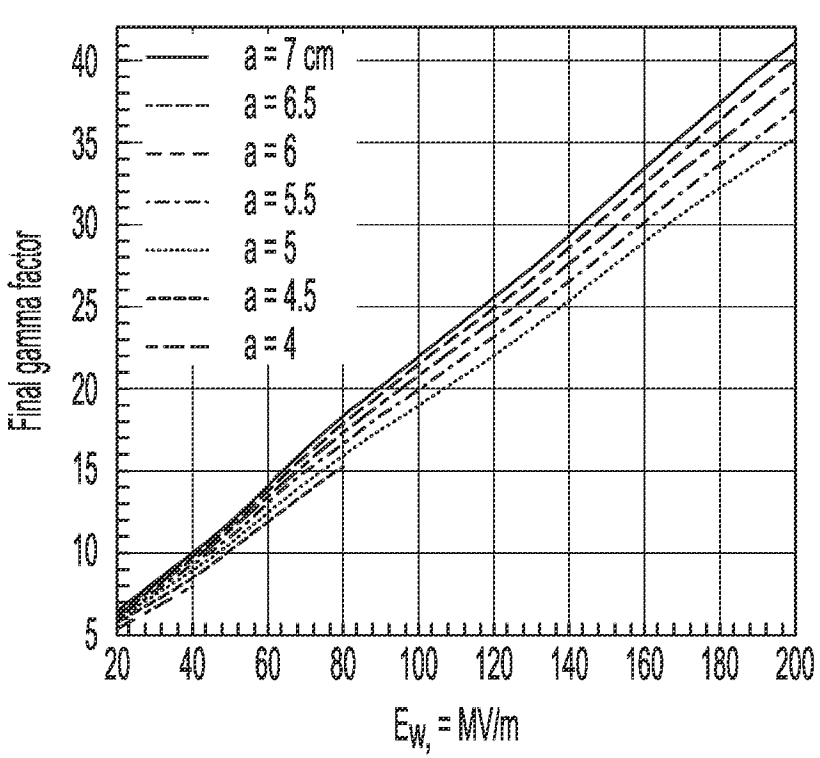

FIGS. 14A-B are a set of charts illustrating the maximum gamma factors and corresponding values of $B_o$ for which the gamma-factor is maximized. The curves are generally linear. Further, a relatively high non-uniformity in the $B_o$ profile can be tolerated without diminution in the acceleration. For example, a linear slope as high as 20% along the axis of a 6.113-cm long cavity showed only a minor change in energy gain. This can be understood, for although cyclotron resonance is indeed a factor in the acceleration mechanism, evidence that energy gain occurs in only a very few orbit turns suggests that the resonance is broad—and thus not sensitive to moderate $B_o$-field variations.

In an aspect, RF-to-beam power efficiency may be an important consideration for an accelerator that produces high average power beams, which may be the case for several use cases of an eCRA accelerator. One assumption, which has been tested with modeling, is that space-charge fields and space-charge forces associated with a finite-current beam neither perturb the imposed RF fields nor the single-particle orbits discussed above. The rationale of these assumptions arises from the fact that particles are not bunched in this interaction, thereby avoiding the strong localized fields associated with high-current bunched beams. Further, the below calculations are based on the cavity geometry being that of a perfect unpenetrated cylinder, free of beam and coupler apertures. Accordingly, it is to be expected that any practical realization of an eCRA is bound to have lower efficiency than found here. Still, in principle, efficiency for the eCRA mechanism can be high, making eCRA a good candidate for various use cases.

The approach taken here begins by specifying the maximum local surface electric field $E_w$ on the $TE_{111}$ cavity wall, since this parameter is linked directly to the maximum acceleration itself. Further, extensive RF breakdown studies offer guidance for determining field limits that ensure reliable operation. In an aspect, the numerical results cited here are for operation at 2.856 GHz, since at this frequency well-developed high-power RF sources, RF components, and RF pulse compressors exist for near-term demonstrations of eCRA. Still, other frequencies such as a lower frequency, for example, 915 or 650 MHz might be preferable, since Ohmic wall losses would be lower, orbit paths in the cavities would be longer. Further, for continuous wave (CW) operation, low-cost high-power efficient magnetrons may be used as an RF source.

Efficiency $\eta$ may be defined as:

$$\eta = \frac{\bar{P}_b}{\bar{P}_b + \bar{P}_w}, \tag{15}$$

where the bars indicate that the electron beam power ($\bar{P}_b$) and cavity wall power ($\bar{P}_w$) are time-averaged values.

The time-averaged beam power is given by $\bar{P}_b = I_{peak} V_{peak} \Delta$, where the sub-scripts denote peak values of beam current I and beam voltage V, to characterize parameters for pulsed beams. The duty-factor, or fraction of time the beam is on, is denoted by $\Delta$. The time-averaged cavity wall power is determined from the relationship $\bar{P}_w = \omega \bar{U}/Q$, where $\bar{U} = U\Delta$ is the time-averaged stored energy in the cavity and Q is the cavity quality factor. There is a limit $p_{lim}$ to the areal average power dissipation that the cavity can in practice sustain; this in turn sets $\bar{P}_w \leq A p_{lim}$, where A is the effective cavity surface area. As a given value of $E_w$ (and thus $P_w$) is required to effect acceleration to a desired level, this in turn sets the duty factor to be $\Delta = A p_{lim}/P_w$.

The stored energy in the cavity U may be determined from $E_w$ as given in a standing-wave cavity by:

$$U = U_e + U_h = \frac{\varepsilon}{2}\iiint E^2 dV + \frac{\mu}{2}\iiint H^2 dV = [\cos(\omega t)]^2 \frac{\varepsilon}{2}\int_V E^2 dV + [\sin(\omega t)]^2 \frac{\mu}{2}\int_V H^2 dV \tag{16}$$

However, when only one mode (or the two degenerate modes) is excited in a cavity, one has $$\frac{\mu}{2}\int_V H^2 dV = \frac{\varepsilon}{2}\int_V E^2 dV. \tag{17}$$

So stored energy, in the absence of losses, does not change with time:

$$U = \left[\cos^2(\omega t) + \sin^2(\omega t)\right]\frac{\varepsilon}{2}\int_V E^2 dV = \frac{\varepsilon}{2}\int_V E^2 dV. \tag{18}$$

Thus, $$\int_V E^2 dV = \left\{\begin{matrix} E_{w,0}^2 \\ E_{w,90}^2 \end{matrix}\right\} W^2 \int_0^L \sin^2(\beta z)dz \int_0^{2\pi} d\varphi \left(\begin{matrix} \sin^2(\varphi) \\ \cos^2(\varphi) \end{matrix}\right) \int_0^a rdr\left[\frac{J_1(k_c r)}{k_c r}\right]^2 + \left\{\begin{matrix} E_{w,0}^2 \\ E_{w,90}^2 \end{matrix}\right\} W^2 \int_0^L \sin^2(\beta z)dz \int_0^{2\pi} d\varphi \left(\begin{matrix} \cos^2(\varphi) \\ \sin^2(\varphi) \end{matrix}\right) \int_0^a rdr[J_1'(k_c r)]^2. \tag{19}$$

This leads to the stored energy in each of the linearly polarized modes to be $$\left\{\begin{matrix} U_0 \\ U_{90} \end{matrix}\right\} = \left\{\begin{matrix} E_{w,0}^2 \\ E_{w,90}^2 \end{matrix}\right\} \pi a^2 L \frac{\varepsilon}{4} \frac{\int_0^{x_{11}} xdx\left[\left(\frac{J_1(x)}{x}\right)^2 + (J_1'(x))^2\right]}{J_1^2(\chi_{11})} \tag{20}$$

Numerical computation finds that $$\frac{\epsilon}{4}\frac{\int_0^{x_{11}} xdx\left[\left(\frac{J_1(x)}{x}\right)^2 + (J_1'(x))^2\right]}{J_1^2(\chi_{11})} = 2.645 \times 10 - 12 \ Farads/m. \tag{21}$$

So the stored energy for each linear polarization becomes $$\left\{\begin{matrix} U_0 \\ U_{90} \end{matrix}\right\} = 2.645 \times 10^{-12} \pi a^2 L \left\{\begin{matrix} E_{w,0}^2 \\ E_{w,90}^2 \end{matrix}\right\} \text{Joules}. \tag{22}$$

For calculations that follow, the sum of both values given by Eq. 22 are used, since eCRA utilizes two $TE_{111}$-modes excited in quadrature, each with the same amplitude.

The quality factor Q for the $TE_{111}$ mode is calculated from the formula:

$$Q\frac{\delta}{\lambda} = \frac{\left[1 - \left(\frac{1}{x_{11}}\right)^2\right]\left[x_{11}^2 + (\pi D/2L)^2\right]^{3/2}}{2\pi\left[x_{11}^2 + (\pi/2)^2(D/L)^3 + \left(1 - \frac{D}{L}\right)\left(\frac{\pi D}{2Lx_{11}}\right)^2\right]}, \tag{23}$$

where $\delta$ is the skin depth and $\lambda$=0.105 m is the wavelength.

Figure 15:
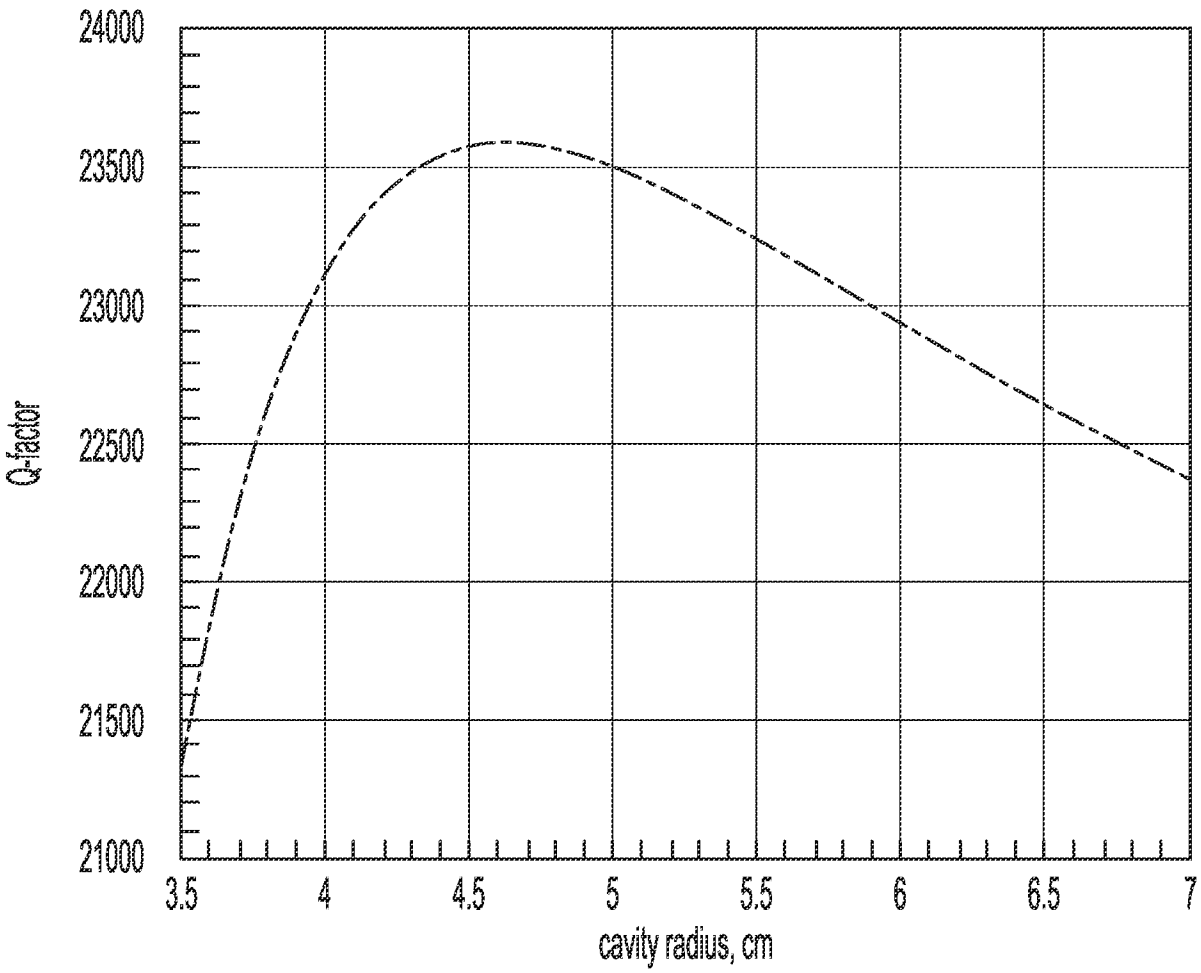
FIG. 15 shows an example curve of a quality factor versus cavity radius for $TE_{111}$ cavities, in accordance with aspects of the present disclosure.

FIG. 15 shows a curve of Q versus cavity radius for $TE_{111}$ cavities whose lengths are chosen for resonance at 2.856 GHz, and for copper walls with a conductivity of $5.87\times10^7$ S/m. Realistic cavities, with beam and coupling apertures, will have lower values. In some implementations, these Q-values could be increased by a factor-of-two or more by employing cryogenic cooling to 77° K. Such cryogenic cooling is not necessary for other implementations operating at room-temperature. These Q-values, together with values of peak stored energy U as determined from Eq. 22 allow calculation of the peak RF power $P_{wall}$ needed to sustain a given values of $E_w$, for a range of cavity radii.

Figure 16:
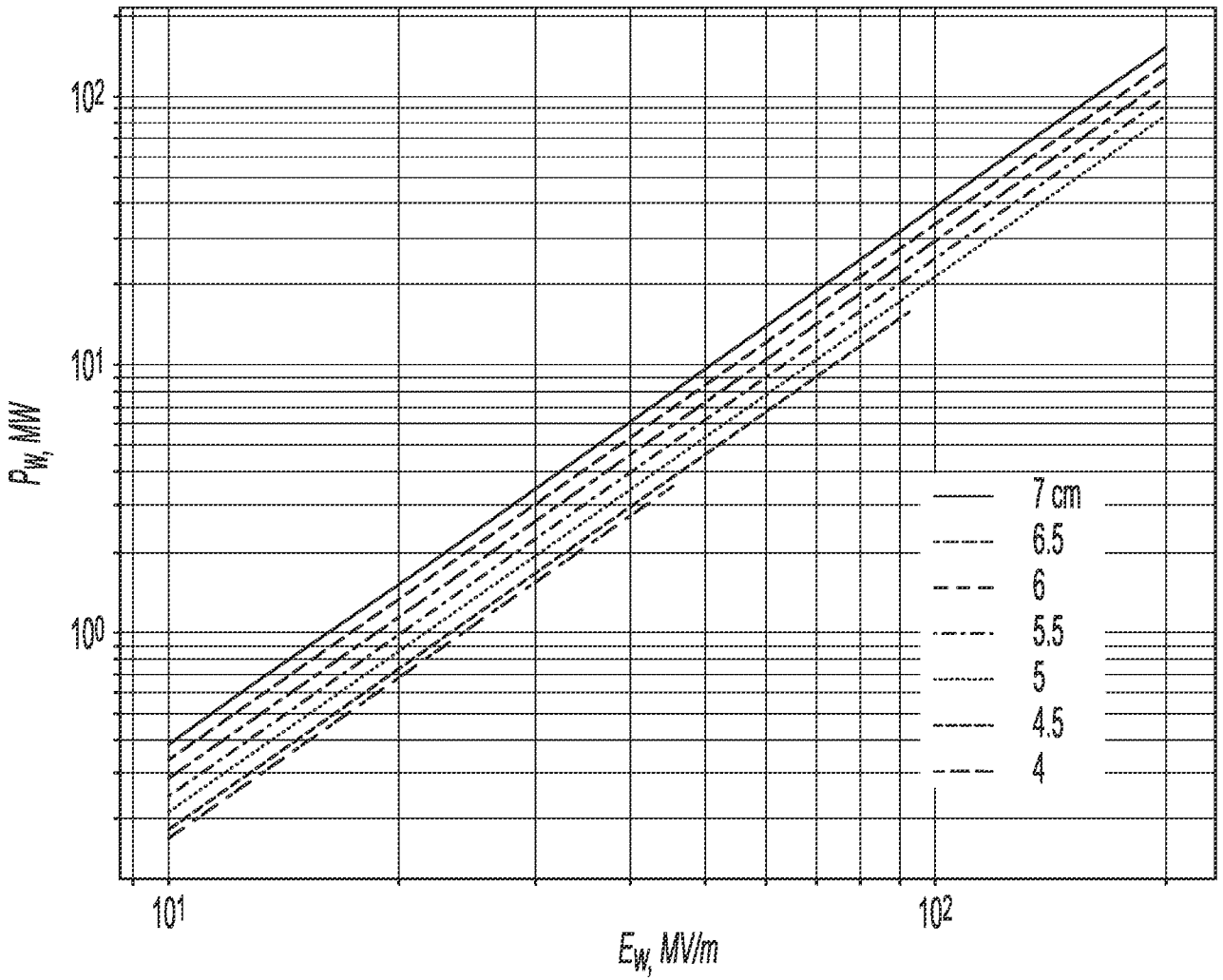
FIG. 16 shows example values of peak RF power needed to sustain the given values of electric field amplitude on the cavity walls for a range of cavity radii, in accordance with aspects of the present disclosure.

FIG. 16 shows values of peak RF power $P_w$ needed to sustain the given values of $E_w$, for a range of cavity radii. Two curves stop short where particle reflections occurred.

As described above, the duty factor $\Delta$ is determined approximately by dividing the peak wall power $P_w$ by the surface area of the cavity $2\pi R(R+L)$ to find the surface-averaged peak areal power pay that must be dissipated on the wall. For an acceptable value of pay, which is denoted as $p_{ok}$, it then follows that $\Delta=p_{ok}/p_{av}$. In the numerical evaluations that follow, a reasonable value of $p_{ok}$=100 W/cm$^2$ is assumed. For example, 100 W/cm$^2$ may be maintained at room temperature using a suitable cooling fluid (e.g., water).

Figure 17:
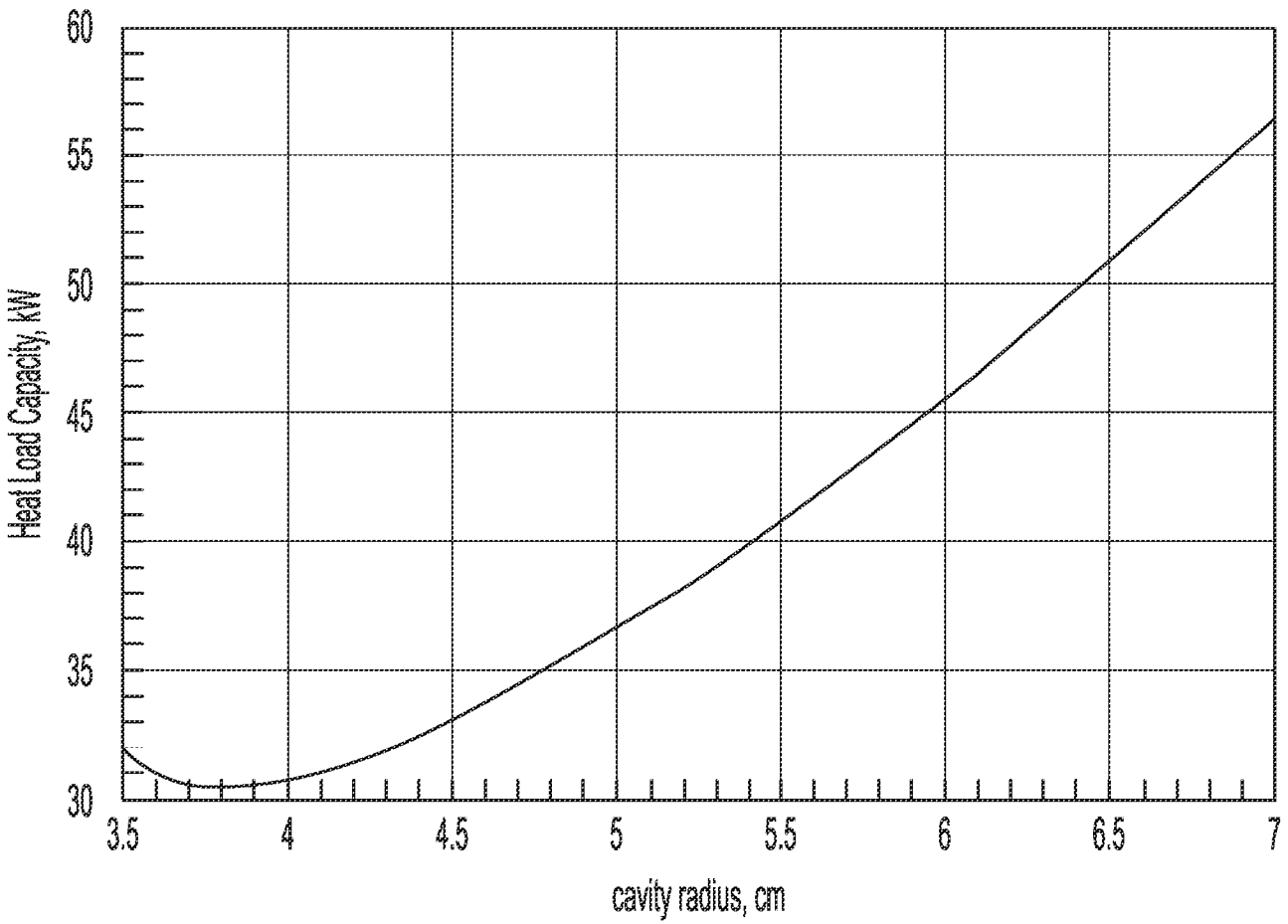
FIG. 17 shows the maximum total wall power that can be dissipated for this assumed value of as a function of radius of a 2.856 GHz cavity, in accordance with aspects of the present disclosure.

FIG. 17 shows the maximum total wall power $\bar{P}_w$ that can be dissipated for this assumed value of $p_{ok}$ as a function of radius of a 2.856 GHz cavity. As illustrated, larger cavities allow dissipation of greater amounts of heat.

Figure 18:
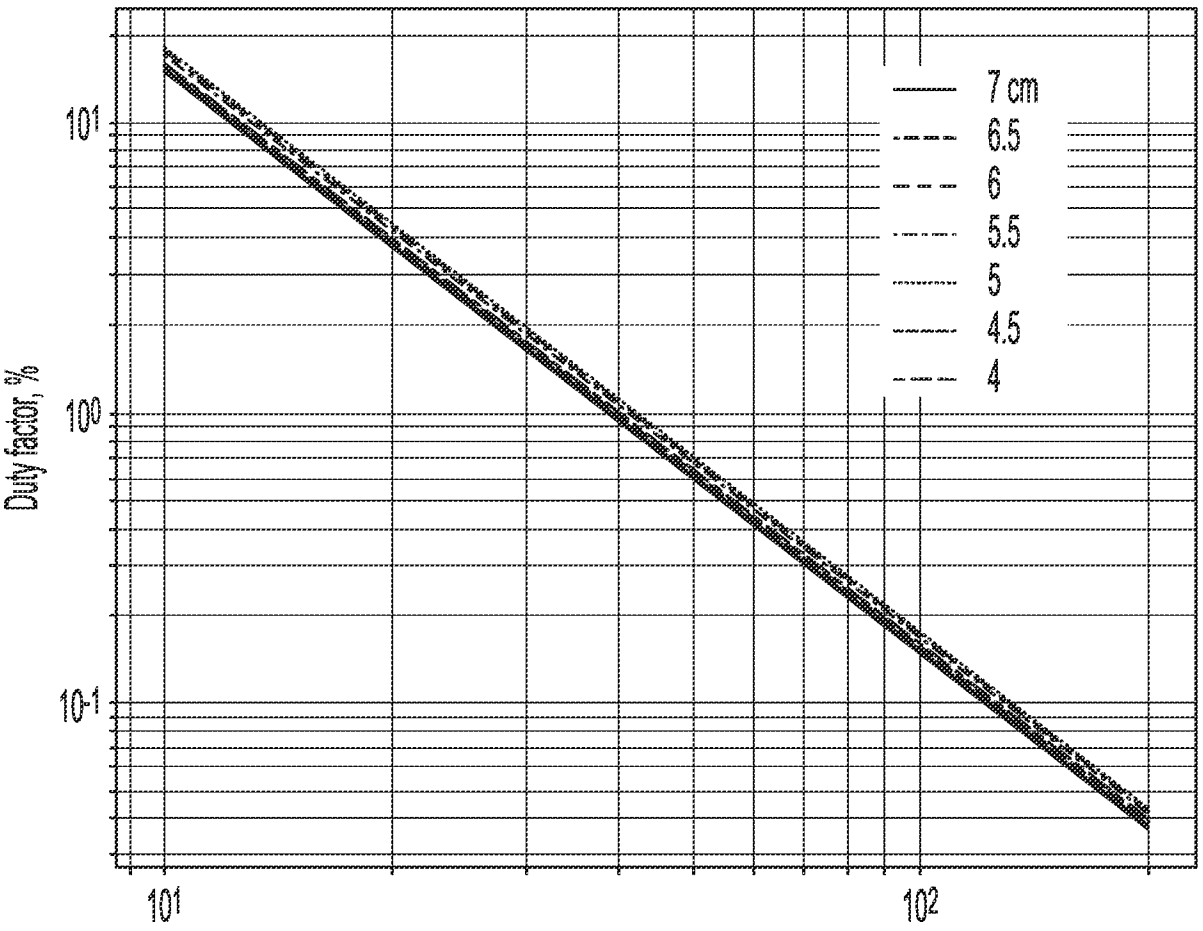
FIG. 18 shows the resulting maximum duty factors based on the averaged peak areal power, in accordance with aspects of the present disclosure.

FIG. 18 shows the resulting maximum duty factors based on the averaged peak areal power. The duty factors $\Delta$ are consistent with the wall heat load values of FIG. 17. As illustrated higher peak energies can be achieved using low duty cycles (e.g., less than 1%). Accordingly, an eCRA system may produce MW-level beams, while limiting cavity wall heating to 100 W/cm$^2$.

While the discussion so far does not take into account beam loading, values of the duty factor need not change when a beam is introduced. That is because the RF power dissipated on the cavity walls is determined directly by $E_w$, and its value can be held constant when a beam is introduced by adding additional RF drive power just sufficient to supply the beam, on top of the power lost to the walls. Use of this common procedure is illustrated here for the specific example of $E_{wall}$=40 MV/m. Beam dynamics calculations described above show for cavities with radii of 5.0, 6.0 and 7.0 cm that beams can be accelerated to final energies up to 4.03, 4.36, and 4.58 MeV, respectively.

Figure 19A:
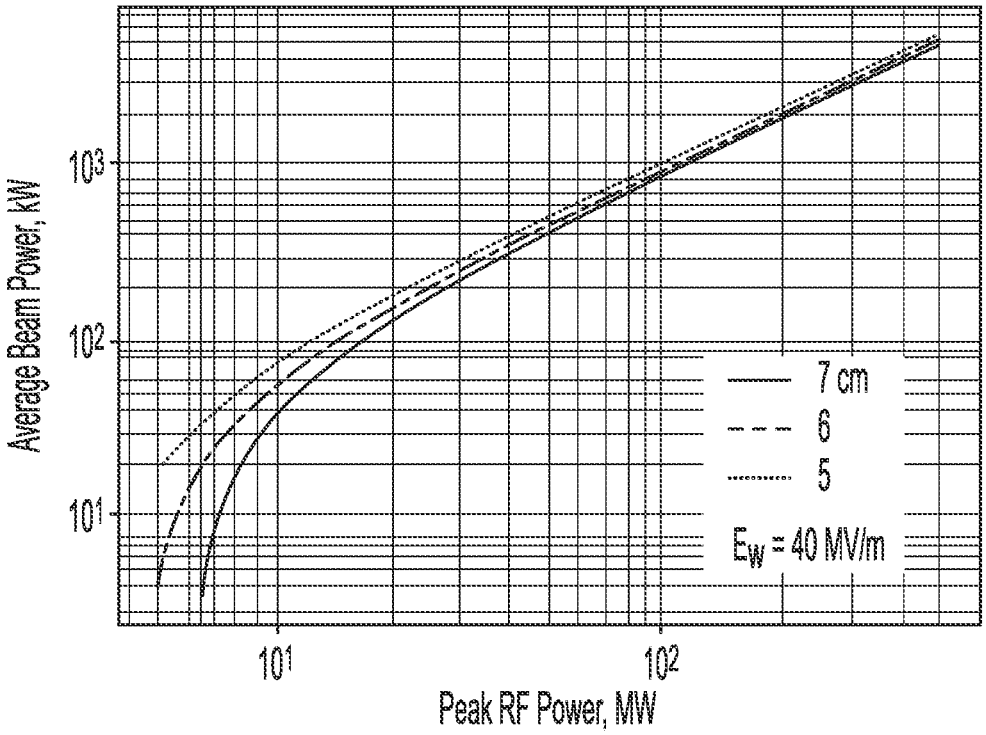
FIGS. 19A, 19B, and 19C show maximum values of average beam power, average beam current, and RF-to-beam efficiency for three cavity radii of 5.0, 6.0 and 7.0 cm, in accordance with aspects of the present disclosure.
Figure 19B:
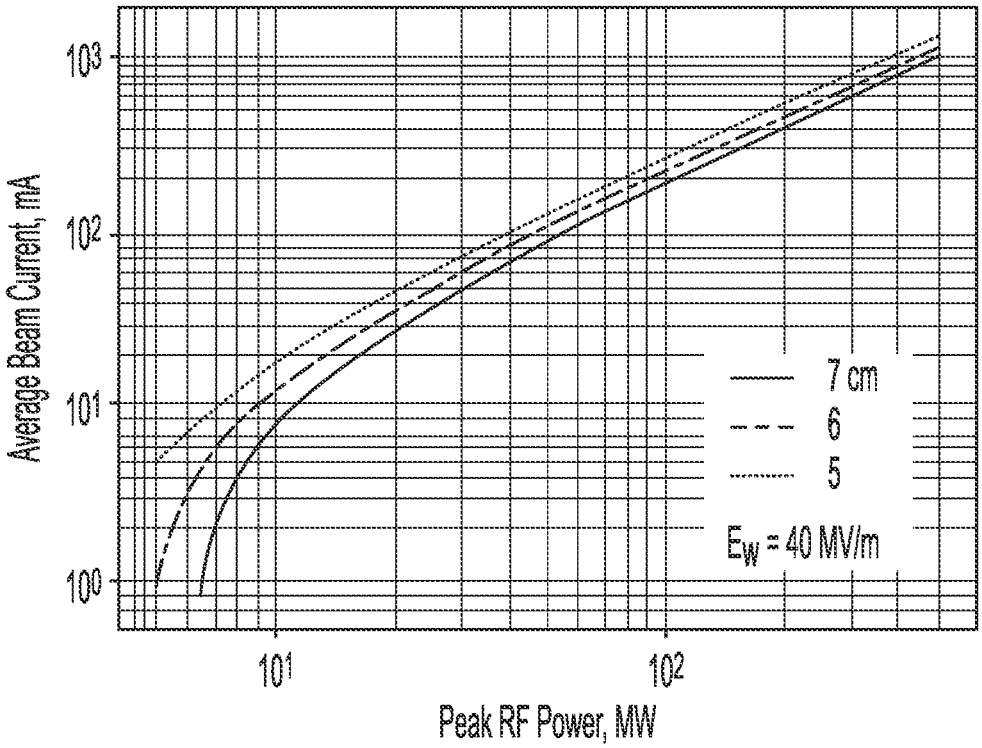
Figure 19C:
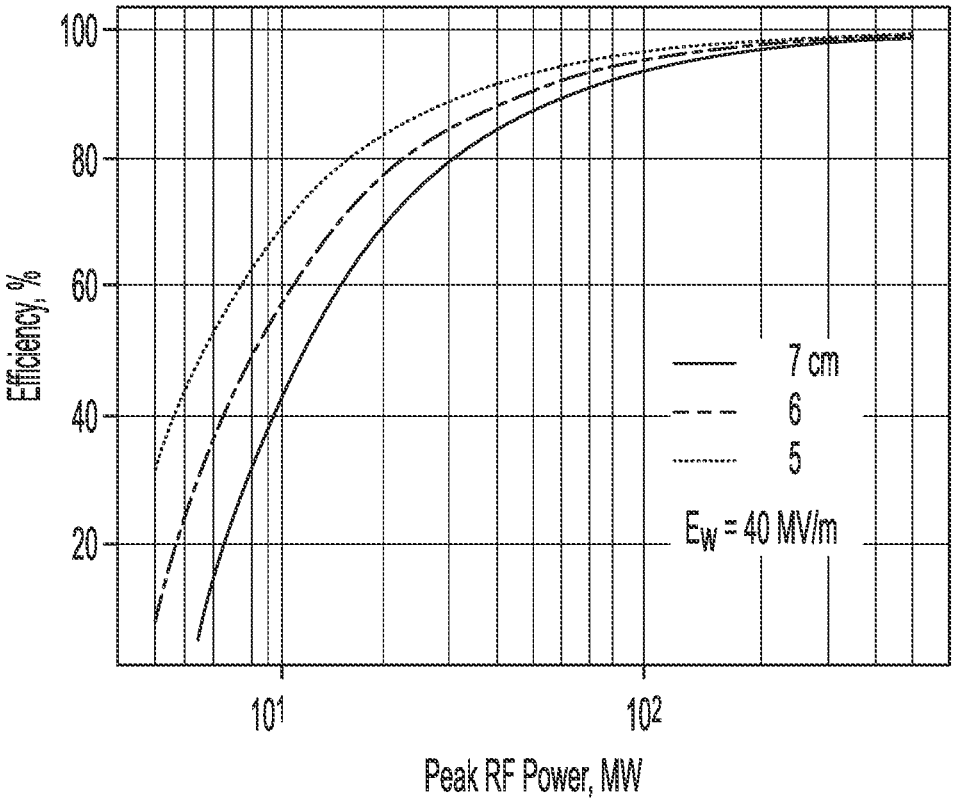

FIGS. 19A, 19B, and 19C show maximum values of average beam power, average beam current, and RF-to-beam efficiency for three cavity radii of 5.0, 6.0 and 7.0 cm. These plots illustrate the theoretical capabilities of eCRA for highly efficient production (e.g., 85% to 99% efficiency) of MW-level beams, while limiting cavity wall heating to 100 W/cm$^2$.

Figure 20A:
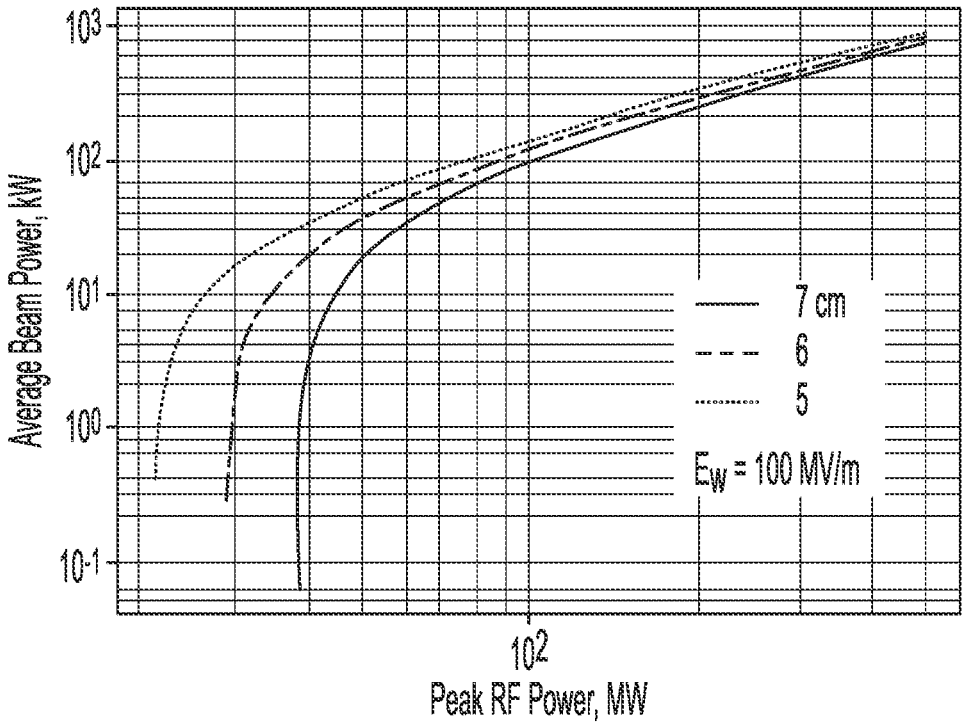
FIGS. 20A, 20B, and 20C show additional examples for beam energies above 10 MeV, in accordance with aspects of the present disclosure.
Figure 20B:
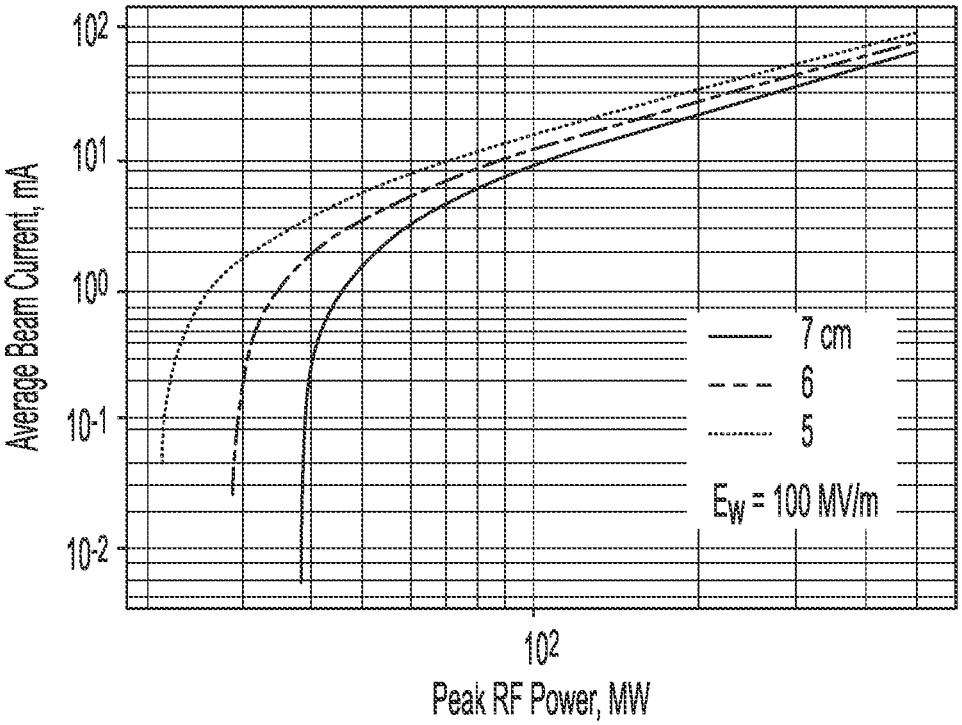
Figure 20C:
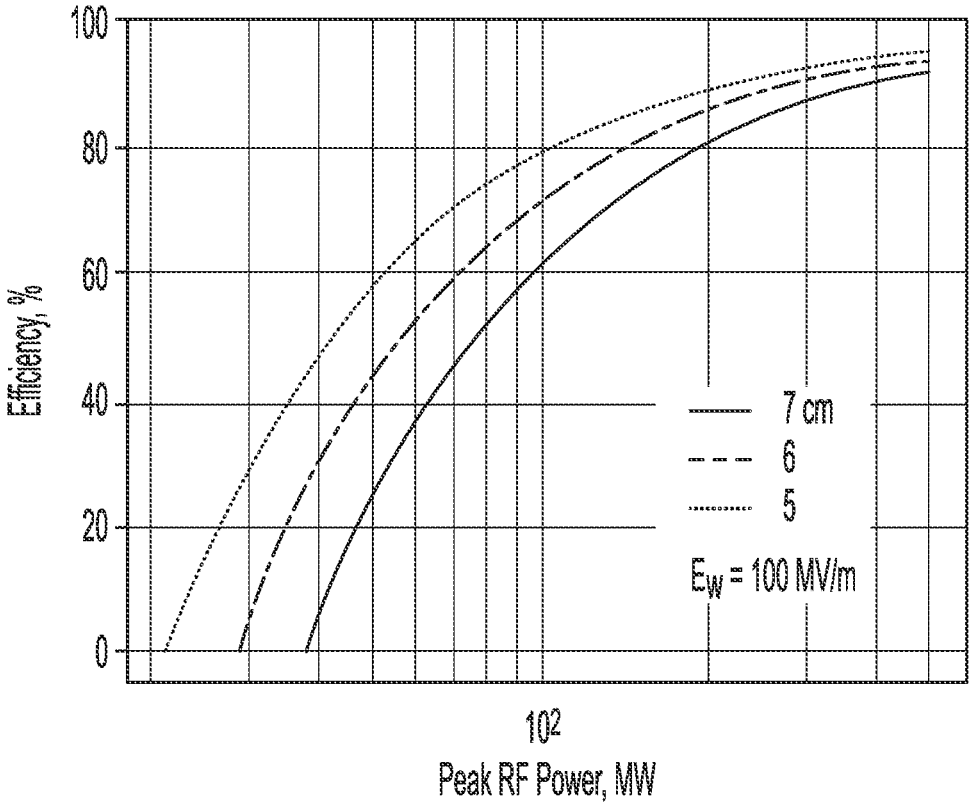

FIGS. 20A, 20B, and 20C show additional examples for beam energies above 10 MeV, where $E_{wall}$=100 MV/m. For these cavities, accelerations up to 9.7, 10.2, and 10.7 MeV, respectively, are predicted.

These examples show where MW- and multi-MW beams at energies between 4.03 and 10.7 MeV could be produced efficiently in highly-compact cavities operating at 2856 MHz. The RF field levels taken for the cavities, with wall fields and average areal powers that do not exceed 100 MV/m and 100 W/cm$^2$ are well within ranges that are reliably sustained.

Exact numerical solutions for the single particle equations of motion have revealed conditions for strong acceleration near cyclotron resonance for electrons injected into a $TE_{111}$-rotating-mode cylindrical cavity immersed in a strong axial magnetic field. The moniker eCRA is designated for this compact accelerator. Acceleration levels without bunching are shown to exceed to a large degree the limits for the CARA interaction, wherein auto-resonance acceleration is sustained for traveling rotating $TE_{11}$-mode waves in a cylindrical waveguide. High current beams with accompanying heavy beam loading are shown to experience acceleration in eCRA to multi-MeV levels for beams with average powers of 100's of kW and efficiencies that exceed 80%. It is shown, to cite one example (see FIGS. 19A, 19B, and 19C), that an effective acceleration gradient of over 90 MV/m (4.5 MeV gain over 5.0 cm) can be sustained with a maximum cavity surface field of only 40 MV/m, when producing a 4.5 MeV, 300 kW average power electron beam, with an RF-to-beam efficiency of about 86%. In this example, the cavity operates at 2.856 GHz, the peak RF power level is 30 MW, and the average cavity surface heating rate is 100 W/cm$^2$. This accelerating cavity is remarkably compact, with a radius and length of each only about 6 cm. Other examples are shown for beams with over one MW-level of average power and energies up to about 20 MeV. A given eCRA cavity is shown to allow wide variation in the accelerated beam energy by changing the RF power level and external magnetic field.

Calculations of beam dynamics in eCRA presented here are based on the single-particle equations of motion in the vacuum fields of an idealized $TE_{111}$ cylindrical microwave cavity. These results are realistic in theory for validating the acceleration mechanism itself. Further, since the beams are not bunched, space-charge fields and forces will alter the results to but a small degree. Thus, eCRA avoids strong field distortions of the cavity fields and beam stability issues that can be associated with tight bunching. Further, the above calculations do not account for a realistic cavity that includes apertures for beam entry and exit, and for RF couplers. Further, the realistic cavity design may include provision for a beam output window. However, in cases where the maximum radial beam excursion is less than the $TE_{11}$-mode cutoff radius (3.078 cm at 2.856 GHz), a beyond-cutoff pipe can be used to define the cavity field boundary, and thus an actual cavity window might not be required to contain the RF fields.

Further, practical applications of eCRA accelerators may be to supply the MW-level powers needed to generate beams or x-rays for wastewater streams, remediation of flue gas and other effluents, and neutralization of toxic solid wastes. Lower power applications could be for beams to generate bremsstrahlung for photonuclear reactions to produce radioisotopes, for sterilization of medical instruments and supplies, and for production of intense THz radiation.

Referring back to FIG. 1, the eCRA system 100 may include a computer system configured to automatically control the generation of accelerated charged electrons and/or various other features of the system 100, such as those used for one or more accelerated beams of electrons, via communication couplings. The communication couplings may be wired and/or wireless couplings, including Wireless Fidelity (WiFi) links, Bluetooth links, General Purpose Interface Bus (GPIB) links, Parallel links, Serial links, Universal Serial Bus (USB) links, Peripheral Component Interconnect (PCI) link, or other suitable communication couplings.

A "processor," as used herein, processes signals and performs general computing and arithmetic functions. Signals processed by the processor may include digital signals, data signals, computer instructions, processor instructions, messages, a bit, a bit stream, or other computing that may be received, transmitted and/or detected.

A "memory," as used herein may include volatile memory and/or non-volatile memory. Non-volatile memory may include, for example, ROM (read only memory), PROM (programmable read only memory), EPROM (erasable PROM) and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDR SDRAM), and/or direct RAM bus RAM (DRRAM).

An "operable connection," as used herein may include a connection by which entities are "operably connected", is one in which signals, physical communications, and/or logical communications may be sent and/or received. An operable connection may include a physical interface, a data interface and/or an electrical interface.

Figure 21:
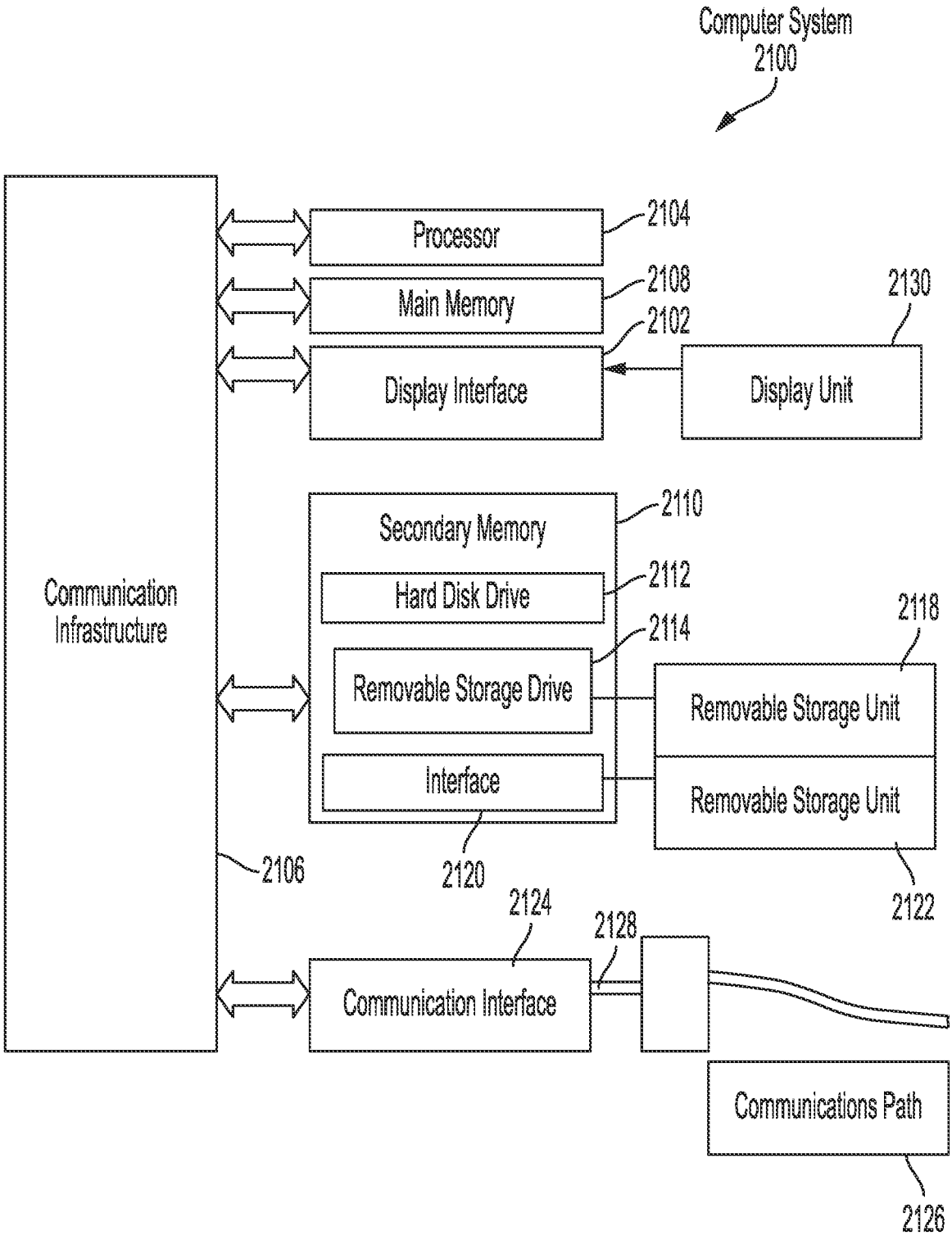
FIG. 21 illustrates an example of a computer system for controlling an eCRA system in accordance with aspects of the present disclosure.

In an aspect of the present disclosure, features are directed toward one or more computer systems capable of carrying out the functionality described herein. An example of such the computer system 2100 is shown in FIG. 21. The computer system 2100 may include one or more processors, such as the processor 2104. The processor 2104 is connected to a communication infrastructure 2106 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

The computer system 2100 may include a display interface 2102 that forwards graphics, text, and other data from the communication infrastructure 2106 (or from a frame buffer not shown) for display on a display unit 2130. Computer system 2100 also includes a main memory 2108, preferably random access memory (RAM), and may also include a secondary memory 2110. The secondary memory 2110 may include, for example, a hard disk drive 2112, and/or a removable storage drive 2114, representing a floppy disk drive, a magnetic tape drive, an optical disk drive, a universal serial bus (USB) flash drive, etc. The removable storage drive 2114 reads from and/or writes to a removable storage unit 2118 in a well-known manner. Removable storage unit 2118 represents a floppy disk, magnetic tape, optical disk, USB flash drive etc., which is read by and written to removable storage drive 2114. As will be appreciated, the removable storage unit 2118 includes a computer usable storage medium having stored therein computer software and/or data.

Alternative aspects of the present disclosure may include secondary memory 2110 and may include other similar devices for allowing computer programs or other instructions to be loaded into computer system 2100. Such devices may include, for example, a removable storage unit 2122 and an interface 2120. Examples of such may include a program cartridge and cartridge interface (such as that found in video game devices), a removable memory chip (such as an erasable programmable read only memory (EPROM), or programmable read only memory (PROM)) and associated socket, and other removable storage units 2122 and interfaces 2120, which allow software and data to be transferred from the removable storage unit 2122 to computer system 2100.

Computer system 2100 may also include a communications interface 2124. Communications interface 2124 allows software and data to be transferred between computer system 2100 and external devices. Examples of communications interface 2124 may include a modem, a network interface (such as an Ethernet card), a communications port, a Personal Computer Memory Card International Association (PCMCIA) slot and card, etc. Software and data transferred via communications interface 2124 are in the form of signals 2128, which may be electronic, electromagnetic, optical or other signals capable of being received by communications interface 2124. These signals 2128 are provided to communications interface 2124 via a communications path (e.g., channel) 2126. This path 2126 carries signals 2128 and may be implemented using wire or cable, fiber optics, a telephone line, a cellular link, an RF link and/or other communications channels. In this document, the terms "computer program medium" and "computer usable medium" are used to refer generally to media such as a removable storage unit 2118, a hard disk installed in hard disk drive 2112, and signals 2128. The term non-transitory computer-readable medium specifically excludes transitory signals. These computer program products provide software to the computer system 2100. Aspects of the present disclosure are directed to such computer program products.

Computer programs (also referred to as computer control logic) are stored in main memory 2108 and/or secondary memory 2110. Computer programs may also be received via communications interface 2124. Such computer programs, when executed, enable the computer system 2100 to perform the features in accordance with aspects of the present disclosure, as discussed herein. In particular, the computer programs, when executed, enable the processor 2104 to perform the features in accordance with aspects of the present disclosure. Accordingly, such computer programs represent controllers of the computer system 2100.

In an aspect of the present disclosure where the method is implemented using software, the software may be stored in a computer program product and loaded into computer system 2100 using removable storage drive 2114, hard drive 2112, or communications interface 2120. The control logic (software), when executed by the processor 2104, causes the processor 2104 to perform the functions described herein. In another aspect of the present disclosure, the system is implemented primarily in hardware using, for example, hardware components, such as application specific integrated circuits (ASICs). Implementation of the hardware state machine so as to perform the functions described herein will be apparent to persons skilled in the relevant art(s).

Figure 22:
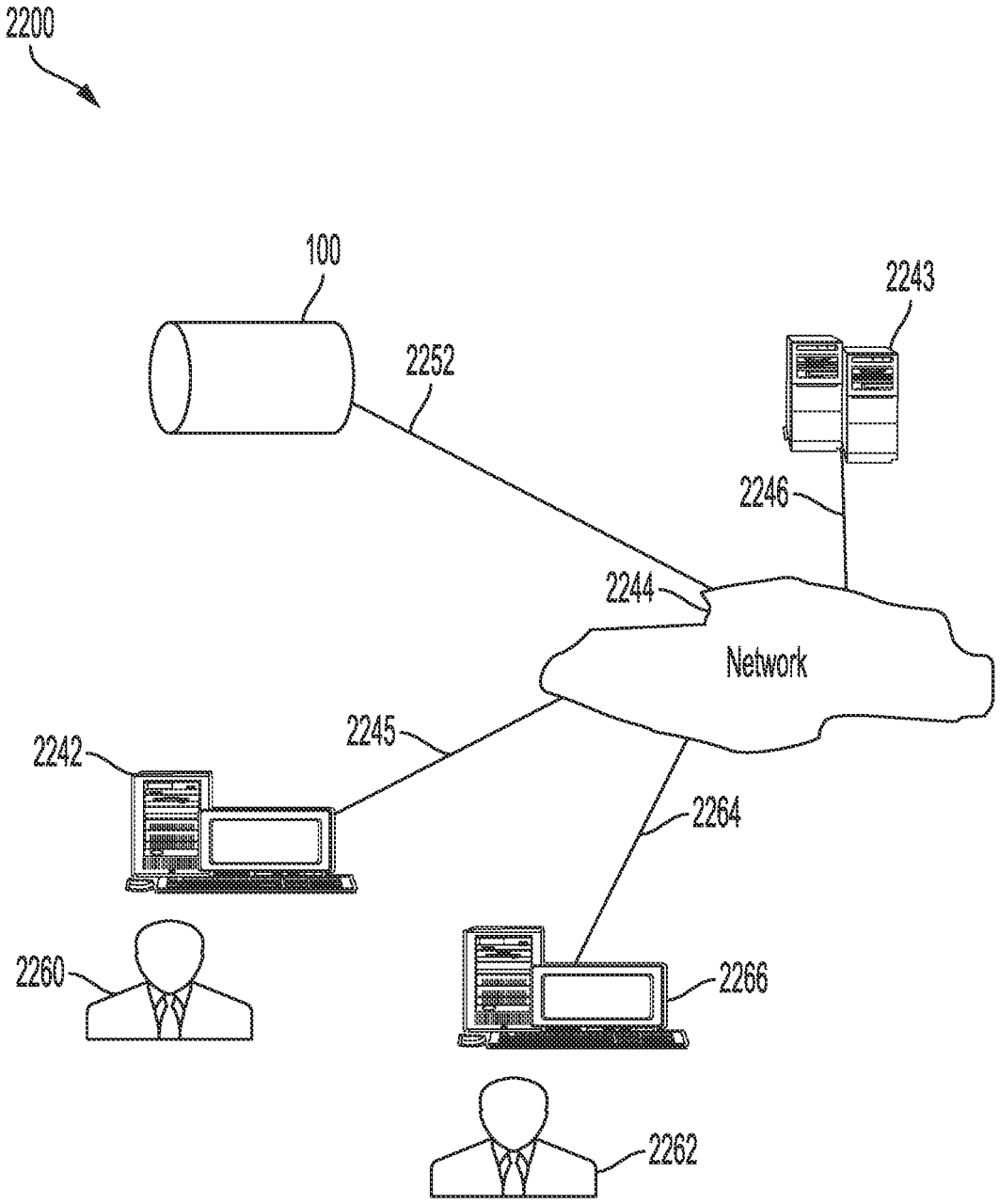
FIG. 22 illustrates a block diagram of various exemplary system components, in accordance with aspects of the present disclosure.

FIG. 22 illustrates a block diagram of various example system components for use with implementations in accordance with an aspect of the present disclosure. FIG. 22 shows a communication system 2200 usable in accordance with aspects of the present disclosure. The communication system 2200 includes one or more accessors 2260, 2262 (also referred to interchangeably herein as one or more "users") and one or more terminals 2242, 2266. In one aspect, data for use in accordance with aspects of the present disclosure may, for example, be input and/or accessed by accessors 2260, 2262 via terminals 2242, 2266, such as personal computers (PCs), minicomputers, mainframe computers, microcomputers, telephonic devices, or wireless devices, such as personal digital assistants ("PDAs") or a hand-held wireless devices coupled to a server 2243, such as a PC, minicomputer, mainframe computer, microcomputer, or other device having a processor and a repository for data and/or connection to a repository for data, via, for example, a network 2244, such as the Internet or an intranet, and couplings 2245, 2246, 2264. The couplings 2245, 2246, 2264 include, for example, wired, wireless, or fiberoptic links. In another example variation, the method and system in accordance with aspects of the present disclosure operate in a stand-alone environment, such as on a single terminal. In some aspects, the eCRA system 100 may be connected to the network 2244 via a coupling 2252. The data from the eCRA system 100 may be accessed via the network 2244 by, for example, the terminals 2242, 2266. The eCRA system 100 may also access data from, for example, the server 2243 via the network 2244.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Also, it will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A device, comprising:

an electron source configured to provide a beam of electrons; and an accelerator including:

a radio frequency (RE) cavity having a longitudinal axis, one or more inlets, and one or more outlets;

an electro-magnet surrounding at least a portion of the RF cavity and configured to produce an axial magnetic field; and at least one pair of waveguides coupling the RF cavity to an RF source configured to generate an RE wave, wherein the RE wave is a superposition of two orthogonal $TE_{111}$ transverse electric modes excited in quadrature to produce an azimuthally rotating standing-wave mode configured to accelerate the beam of electrons axially entering the RF cavity with non-linear cyclotron resonance acceleration.

2. The device of claim 1, Wherein the RF cavity is maintained at room temperature.

3. The device of claim 2, wherein the RF cavity is a copper cavity including channels for water cooling.

4. The device of claim 1, wherein the beam of electrons remains un-hunched.

5. The device of claim 1, wherein parameters of the $TE_{111}$ modes are not tuned to conform to an auto-resonance condition.

6. The device of claim 1, wherein the azimuthally rotating standing-wave mode allows slippage in phase between momentum of the electrons and the RE wave.

7. The device of claim 6, wherein the slippage in phase favors energy transfer to the electrons and avoids energy transfer back to the RF wave.

8. The device of claim 1, wherein the at least one pair of waveguides are coupled to the RF cavity at a 90 degree angle to each other.

9. The device of claim 1, wherein temporal phases in the RF wave of the at least one pair of waveguides are separated by 90 degrees.

10. The device of claim 1, wherein an electron in the accelerated beam of electrons exiting the RF cavity traces a circular helical pattern around a respective axis when the magnetic field is constant.

11. The device of claim 1, wherein the RF cavity, the electro-magnet, and the electron source are arranged along a vertical axis, wherein the magnetic field is configured to deflect the accelerated beam of electrons to scan in a horizontal plane.

12. The device of claim 1, wherein the RF cavity, the electro-magnet, and the electron source are arranged along a horizontal axis directed toward a target to be irradiated.

13. The device of claim 1, wherein the accelerator is configured for pulsed operation with a maximum duty cycle based on the RF source or a surface-averaged peak areal power to be dissipated by walls of the RF cavity.

14. The device of claim 13, wherein the pulsed operation provides a peak accelerating field in the RF cavity for accelerating the beam of electrons higher than continuous operation for a same average power.

15. The device of claim 1, wherein the accelerator provides an effective acceleration gradient of at least 75 MeV/m with a maximum surface field of 40 MV/m when producing an electron beam with 4.5 MeV energy and at least a 300 kW power.

16. The device of claim 15, wherein an efficiency of the accelerator is between 85% and 99%.

17. A method, comprising:

receiving, at an RF cavity within an axial magnetic field, a beam of electrons via one or more inlets;

applying a radio frequency (RE) wave to the RF cavity, wherein the RE wave is a superposition of two $TE_{111}$ orthogonal transverse electric modes excited in quadrature to produce a rotating standing-wave mode configured to accelerate the beam of electrons axially entering the RE cavity with non-linear cyclotron resonance acceleration; and emitting the accelerated beam of electrons via one or more outlets.

18. The method of claim 17, further comprising maintaining the RF cavity at room temperature.

19. The method of claim 17, further comprising pulsing the RE wave with a maximum duty cycle based on a limit of a RE source or a surface-averaged peak areal power to be dissipated by walls of the RF cavity.

20. The method of claim 17, further comprising directing the accelerated beam of electrons toward a target, wherein the accelerated beam of electrons impinges on the target to create x-rays.

21. The method of claim 20, wherein the RE cavity is arranged along a vertical axis, the method further comprising deflecting the accelerated beam of electrons to scan in a horizontal plane, wherein the target is cylindrical.

22. The method of claim 20, wherein the x-rays are directed to one of: a medical device, food, or insect to be sterilized; an electronic or industrial weld or nuclear material to be inspected; or a well to be measured.

23. The method of claim 17, further comprising directing the accelerated beam of electrons toward a waste stream to be irradiated.

24. The method of claim 17, wherein a plurality of electrons within the beam of electrons remain un-bunched.

25. The method of claim 17, wherein the beam of electrons exiting the RF cavity trace a circular helical pattern around respective axes when the magnetic field is constant.

26. The method of claim 17, wherein parameters of the $TE_{111}$ modes are not tuned to conform to an auto-resonance condition.

27. The method of claim 17, wherein the rotating standing-wave mode allows slippage in phase between momentum of the electrons and the RF wave.

28. The method of claim 27, wherein the slippage in phase favors energy transfer to the electrons and avoids energy transfer back to the RF wave.

* * * * *